US011141768B2

(12) United States Patent
Embrechts

(10) Patent No.: US 11,141,768 B2
(45) Date of Patent: Oct. 12, 2021

(54) AUTOMATED PRESS BRAKE OR BENDING MACHINE FOR BENDING METAL SHEET MATERIAL AND METHOD FOR BENDING METAL SHEET MATERIAL WITH SUCH AN AUTOMATED PRESS BRAKE OR BENDING MACHINE

(71) Applicant: ZEISER ENGINEERING UAB, Vilnius (LT)

(72) Inventor: Bart Embrechts, Moorsel (BE)

(73) Assignee: ZEISER ENGINEERING UAB, Vilnius (LT)

( * ) Notice: Subject to any disclaimer, the term of this patent is extended or adjusted under 35 U.S.C. 154(b) by 319 days.

(21) Appl. No.: 15/737,039

(22) PCT Filed: Jun. 15, 2016

(86) PCT No.: PCT/IB2016/053542
§ 371 (c)(1),
(2) Date: Dec. 15, 2017

(87) PCT Pub. No.: WO2016/203398
PCT Pub. Date: Dec. 22, 2016

(65) Prior Publication Data

US 2018/0361451 A1 Dec. 20, 2018

(30) Foreign Application Priority Data

Jun. 16, 2015 (BE) ..... 2015/5365

(51) Int. Cl.
*B21D 5/00* (2006.01)
*B21D 5/02* (2006.01)

(52) U.S. Cl.
CPC ..... *B21D 5/004* (2013.01); *B21D 5/0218* (2013.01); *B21D 5/0227* (2013.01)

(58) Field of Classification Search
CPC .. B21D 5/0209; B21D 5/0218; B21D 5/0227; B21D 5/0236; B21D 5/0254;
(Continued)

(56) References Cited

U.S. PATENT DOCUMENTS 8,683,834 B1 * 4/2014 Macaulay ..... B21D 5/004 72/18.9
10,500,623 B2 * 12/2019 Meneghetti ..... B21D 5/02
(Continued)

FOREIGN PATENT DOCUMENTS

EP 2364789 9/2011
JP H07100540 4/1995
(Continued)

OTHER PUBLICATIONS

EPO Machine Translation of JP 2001001048 (Year: 2019).*
International Search Report for PCT/IB2016/053542, Completed by the European Patent Office dated Aug. 31, 2016, 3 Pages.

*Primary Examiner* — Debra M Sullivan
(74) *Attorney, Agent, or Firm* — Brooks Kushman P.C.

(57) ABSTRACT

An automated bending machine for bending metal sheet material, provided with driving means which are integrated in a table and/or ram depending on whether the driving means are designed for moving and arranging bottom tools and/or top tools respectively on the respective tool holder of the automated bending machine, whereby the driving means are such that several tool segments can be simultaneously controlled with the latter in order to make these multiple tool segments simultaneously undergo a movement, independently from one another, along the tool holder concerned.

32 Claims, 17 Drawing Sheets

(58) Field of Classification Search
CPC ..... B21D 5/0281; B21D 5/002; B21D 5/004; B21D 5/02
See application file for complete search history.

(56) References Cited

U.S. PATENT DOCUMENTS

| | | | | |
|---|---|---|---|---|
| 2011/0219844 | A1* | 9/2011 | Battheu ..... | B21D 5/0209 72/389.4 |
| 2014/0132720 | A1* | 5/2014 | Rogers ..... | B21D 5/004 348/46 |

FOREIGN PATENT DOCUMENTS

| | | |
|---|---|---|
| JP | 2001001048 | 1/2001 |
| JP | 2004322199 | 11/2004 |
| WO | 2015118505 | 8/2015 |

* cited by examiner

AUTOMATED PRESS BRAKE OR BENDING MACHINE FOR BENDING METAL SHEET MATERIAL AND METHOD FOR BENDING METAL SHEET MATERIAL WITH SUCH AN AUTOMATED PRESS BRAKE OR BENDING MACHINE

CROSS-REFERENCE TO RELATED APPLICATION

This application is the U.S. national phase of PCT Application No. PCT/IB2016/053542 filed on Jun. 15, 2016, which claims priority to BE Patent Application No. 2015/5365 filed on Jun. 16, 2015, the disclosures of which are incorporated in their entirety by reference herein.

First or all, the present invention concerns an automated press brake or bending machine for bending metal sheet material.

More specifically, the invention concerns an automated press brake or bending machine which is provided with:

- a table with a lower tool holder on which bottom tools in the form of one or several dies can be arranged;
- a movable beam or ram with an upper tool holder on which top tools in the form or one or several punches can be arranged;
- driving means for moving and mounting the bottom tool and/or the top tool on the tool holder concerned; and,
- a control unit for controlling the driving means.

Usually, the table is static and the movable beam or ram can be moved up and down in relation to the table.

We refer to these as "down stroke" press brakes or bending machines.

However, the invention also relates to what are called "up stroke" bending machines or press brakes, whereby the table can be moved up and down in relation to the movable beam or ram.

The invention also concerns angle benders or bending machines whereby the ram as well as the table can move in relation to one another.

The dies and punches are hereby each formed of a tool segment which can be moved back and forth over the length of the tool holder concerned.

The aim is to place several such tool segments next to one another in the length of the press brake or bending machine so as to form an assembled set of tool segments with which a workpiece of metal sheet material can be folded.

It is clear that, usually, a number of bending operations will have to be carried out on one and the same workpiece in order to achieve a desired end product.

Several portions of such a workpiece hereby usually have to be folded over a varying folding length, whereby each fold over such a folding length is achieved with another assembled set of tool segments.

Depending on the thickness of the metal sheet material to be folded, usually other types of dies and punches are used.

In larger production halls, usually batches formed of several workpieces to be processed having the same plate thickness are successively finished, so that the type of dies and punches being used only need to be changed when proceeding to another batch of workpieces.

Automated press brakes or bending machines for bending metal sheet material are already known, but they have a number of disadvantages.

With a first type of known automated press brakes or bending machines the automation consists in preparing the bottom tool holder and the top tool holder before starting to process a new batch of work pieces.

To this end, use is usually made of robots or similar automated installations with which the tool segments can be brought from a storage area to the tool holder.

In order to be able to perform the various folding operations for a single batch without needing to reposition the tool segments between successive folding operations, several assembled sets of tool segments are distributed over the entire length of the tool holder, next to one another, in these known automated press brakes or bending machines.

Thus, folding operations with different fold lengths are performed at different parts of the press brake or bending machine, arranged next to one another along the length of the tool holder, each in accordance with an assembled set of tool segments.

A first disadvantage of these known automated press brakes or bending machines is that preparing the tool holder is relatively time-consuming, whereby the sheet metal worker cannot deliver any output during this time.

Thus, a major part of the production time is lost to preparing the press brake or bending machine.

Another disadvantage of these known automated press brakes or bending machines is that the sheet metal worker must constantly move the work piece to be processed between the different assembled sets of tool segments in order to perform the folding operation in accordance with the appropriate fold length.

The work piece must hereby be properly positioned and rotated all the time, which is often complicated, so that the sheet metal worker must be very attentive to avoid mistakes or unsafe situations.

Due to the presence of several assembled sets of tool segments it is possible, for example, for a sheet metal worker to present a work piece to the wrong set, resulting in an incorrect folding of the work piece, which may possibly lead to dangerous situations.

Further, the constant switching between the different assembled sets of tool segments is also physically very demanding to the sheet metal worker.

In many cases, these types of known automated press brakes or bending machines have a monitor showing the sheet metal worker how the work piece should be placed on the press for the next folding operation. Such a monitor is usually installed next to the zone of the table and ram.

However, a disadvantage of these known automated press brakes or bending machines, related to their nature, is that the monitor is set up far away from the sheet metal worker, since such press brakes or bending machines have a great length in order to be able to house the assembled sets of tools provided next to one another over the length of the press.

Consequently, a sheet metal worker often loses time in going to the monitor.

Another disadvantage of these known automated press brakes or bending machines is that the assembled sets of tool segments are not centred in the middle of the press, which is not ideal for the distribution of power in the press and which may also give rise to inaccuracies during the folding of the work piece.

In the known automated bending machines or press brakes it is conceivable to reposition tool segments with the intention to convert a first assembled set of tool segments in a differently configured assembled set of tool segments.

A disadvantage of these known automated press brakes or bending machines consists in that, in order to move the tool segments during their repositioning, an automated gripping tool is used which is parked, however, in a parking zone of the press brake provided to that end, usually laterally with respect to the table and the ram of the press brake or bending machine.

Consequently, this gripping tool must always be moved to the tool segment concerned, which is very time-consuming.

Further, the gripping tool can only pick up one tool segment at a time, meaning that an entire re-configuration of an assembled set of machine tools is very time-consuming due to the repositioning of several tool segments.

Another disadvantage of the known automated press brakes or bending machines is related to the specific situation in which it is not possible to obtain a certain fold length.

For example, sometimes it is impossible to achieve the appropriate fold length by forming an assembled set of tool segments because the different tool segments do not have the required width.

In this situation is often formed an assembled set of tool segments with a fold length which is somewhat shorter than the required fold length.

Of course, the difference between the required fold length and the accomplished one is preferably evenly distributed over the entire fold length by arranging the tool segments somewhat apart.

In the known automated press brakes or bending machines, said positioning of the tool segments with a certain interspace is very time-consuming, since several sequential movements are necessary to accomplish this.

From JP2004322199A is known an automated press brake or bending machine which makes it possible to fold a work piece over different fold lengths or to process it with different tools.

A number of tool segments are hereby distributed at a certain distance from one another, next to one another, over the lower tool holder, as well as over the upper tool holder.

Such an automated press brake or bending machine according to JP2004322199A is also provided with driving means for moving and arranging the bottom tool and/or the top tool on the respective tool holder and with a control unit for controlling these driving means.

A major disadvantage of such an automated press brake or bending machine according to JP2004322199A, however, is that the mutual distance between the different tool segments cannot be altered.

More specifically, in order to obtain a desired configuration, the entire arrangement of tool segments on the upper tool holder is shifted as a whole in relation to the entire arrangement of tool segments on the lower tool holder to thus place the required tool segments on the lower tool holder and the upper tool holder one above the other at the work piece to be processed.

Thus, with such an automated press brake or bending machine according to JP2004322199A, tool segments cannot be combined in a flexible manner into a desired assembled set of tool segments.

Moreover, the applied method has for a result that very long, even unrealistically long bending machines must be designed in order to benefit somewhat from the method.

Also, the present invention aims to remedy one or several of the above-mentioned and/or other disadvantages.

More specifically, the invention aims to offer an automated press brake or bending machine which reduces the production time for manufacturing work pieces by bending metal sheet material.

Another aim of the present invention consists in unburdening a sheet metal worker who operates an automated press brake or bending machine according to the invention, both mentally and physically.

Another aim of the present invention consists in offering an automated press brake or bending machine which is safer.

Yet another aim of the invention consists in making optimal use of the forces developed in the automated press brake or bending machine according to the invention and in increasing the accuracy of the operations compared with the known automated press brakes or bending machines.

Another aim of the invention consists in providing an automated press brake or bending machine wherein the driving means make optimal use of the available space and whereby, with as little means as possible, different configurations of the press brake or bending machine can be achieved in a very dynamic and a very fast way.

Another aim of the invention consists in providing an automated press brake or bending machine wherein tool segments can be combined into another set in the time span wherein the movable beam or ram moves up and down in order to obtain a machine which allows for a continuous operation for performing a wide range of folding operations.

To this aim, the present invention concerns an automated press brake or bending machine for bending metal sheet material, which is provided with:

- a table with a lower tool holder on which bottom tools in the shape of one or several dies can be provided;
- a movable beam or ram with an upper tool holder on which top tools in the shape of one or several punches can be provided;
- driving means for moving and arranging the bottom tools and/or the top tools on the tool holder concerned; and,
- a control unit for controlling the driving means, whereby the dies and punches are each formed of a tool segment which can be moved back and forth over the length of the tool holder concerned, whereby the driving means are integrated in the table or ram depending on whether the driving means are designed for moving and arranging the bottom tools and/or the top tools respectively on the tool holder concerned, and whereby the driving means are such that several tool segments can be simultaneously controlled with the latter to make said plurality of tool segments undergo a movement simultaneously and independently from one another along the tool holder concerned.

According to a preferred embodiment of an automated press brake or bending machine in accordance with the invention, the driving means are more specifically integrated in the tool holder concerned.

A major advantage of such an automated press brake or bending machine according to the invention is that it is provided with driving means which are entirely integrated in the table, the ram or in the corresponding tool holders.

As a result, the time required for moving a tool segment on the tool holder is greatly reduced compared to the time required by the known automated press brakes or bending machines, since with a press brake or bending machine according to the invention there is no need to bridge a distance between a parking zone and the tool segment concerned each time.

With an automated press brake or bending machine wherein the driving means are integrated in the table, the ram or in the corresponding tool holders, the driving means are arranged such that they do not or do not significantly occupy the work area of the bending machine just before or just behind the table or ram.

The space in which the driving means are present in that case (or may be present during their operation) does not or does not significantly reach into the work area of the bending machine.

This work area is generally regarded as the space just behind or just before the ram or table or the space just underneath the tool holder concerned.

The driving means hereby occupy less than 2 litres/m bending machine of the space just behind or in front of the ram or table.

As, in an automated press brake or bending machine according to the invention, the driving means are such that several tool segments can be simultaneously controlled with the latter so as to make this plurality of tool segments undergo a movement simultaneously and independently from one another along the tool holder concerned, a very dynamic machine is moreover obtained which can present the tool segments in the right way to an operator during the entire bending process, whereby the bending process proceeds continuously and is not interrupted, and whereby there is not any significant unnecessary delay between successive steps in the bending process.

According to yet another preferred embodiment of an automated press brake or bending machine in accordance with the invention, the driving means contain at least one motor, whereby this motor is such that several tool segments can be simultaneously driven with the latter so as to make this plurality of tool segments undergo a linear movement independently from one another along the tool holder concerned.

A major advantage of such an embodiment of an automated press brake or bending machine in accordance with the invention is that the driving means contain at least one motor which makes it possible to make several tool segments simultaneously undergo intricate movements, independently from one another.

Such a motor can be made very compact, whereas the motor can make several tool segments simultaneously undergo intricate movements.

Such a compact motor is perfect to be integrated in the table or ram of the automated press brake or bending machine or in the lower or upper tool holder, as applicable.

Moreover, by controlling several tool segments simultaneously and independently from one another, one can switch in a very fast manner from a first configuration wherein the available tool segments are grouped into a first assembled set of tool segments to a second configuration wherein the available tool segments are grouped into a second assembled set of tool segments.

Thus can be obtained a very dynamic automated press brake or bending machine, wherein the tool segments can be arranged in between two operations, for example while the ram goes up and down, as a function of the next operation to be carried out, without this even slightly delaying the production process.

In an even more preferred embodiment of an automated press brake or bending machine in accordance with the invention, the driving means consist of one or several linear motors which are each formed of a series of electromagnets arranged fixedly in relation to the table or ram which are integrated in one of the tool holders, whereby every electromagnet is electrically controllable as separate, whereby every linear motor contains a series of controlled elements, whereby several controlled elements can by simultaneously controlled by the electromagnets so as to make them undergo a linear movement along the tool holder concerned, and whereby the controlled elements can be coupled to the tool segments of the tool holder concerned.

A major advantage of such an embodiment of an automated press brake or bending machine according to the invention consists in that the linear motors of the press brake or bending machine are provided with a control unit with which several controlled elements and thus also tool segments can be simultaneously controlled and moved, independently from one another.

This obviously results in tremendous time savings when moving tool segments.

The achieved time-saving is so great that, with an automated press brake or bending machine according to the invention, it becomes possible to compose sets of tool segments in a dynamic manner, more specifically in between two folding operations and without considerably disturbing the entire bending process.

As is known, in order to perform a folding operation, the work piece is first placed against a stop for a correct positioning thereof and then, as a result of a downward movement, the ram is brought up to the table, after which the ram undergoes an upward movement so as to take the previously clamped work piece away.

In order to reconfigure an assembled set of tool segments into a new set of tool segments by repositioning, adding, removing, sliding sideways and/or sliding away tool segments, and in order to possibly move one or several stops, an automated press brake or bending machine according to the invention can do with the time which is available as of the moment the ram starts its upward movement until the moment the work piece is placed against a stop of the press brake or the bending machine again for a next folding operation.

This not only offers a tremendous gain of time, it also implies that, with an automated press brake or bending machine according to the invention, for each folding operation, the correctly assembled set of tool segments will be offered to the sheet metal worker, such that the sheet metal worker no longer has to drag the work piece along the length of the press brake or the bending machine.

Consequently, the tasks of the sheet metal worker are greatly simplified, which results in a huge relief both physically and mentally, and thus also in a larger productivity.

According to yet another preferred embodiment of an automated press brake or bending machine in accordance with the invention, its control unit is a dynamic control unit with which the tool segments, in between successive folding operations, can be positioned into an assembled set of tool segments in the most ideal place along the tool holder without any noticeable interruption in the bending process, whereby the middle is preferably centred in the middle of the length of the table and the ram.

Naturally, there will not be any noticeable interruption in the bending process if the press brake or the bending machine can be reconfigured within the above-mentioned time that is available between the moment when the ram starts its upward movement and the moment when the work piece is presented again for a new folding operation.

A major advantage of this embodiment of an automated press brake or bending machine according to the invention is that every folding operation takes place in a manner wherein the middle of the work piece is aligned with the middle of the press brake or bending machine, as a result of which the forces in the press brake or the bending machine will be optimally distributed and the folding operations will be carried out with greater accuracy.

Another major advantage is that a work table can be provided in front of the machine where the operator can do his job while being seated. This is possible, as the bending is always performed in the same place.

Another advantage of such an automated press brake according to the invention is that it may have a shorter length than the known automated press brakes or bending machines, since only one assembled set of tool segments at a time is arranged on the press brake or bending machine, such that the required length of such a press brake or bending machine corresponds to the maximal length of an assembled set of tool segments.

In practice, an automated press brake or bending machine according to the invention can thus be made with a length which is about 1.5 to 1.75 times the aforesaid maximal length, whereas the length of the known automated press brakes and bending machines is usually a multiple thereof.

The present invention also concerns a method for bending metal sheet material with an automated press brake or bending machine, as described above, whereby the method consists in always positioning the tool segments with the driving means of the press brake or bending machine in such a manner in between successive folding operations that each folding operation can be performed with an assembled set of tool segments which is positioned on the most ideal location along the tool holder, whereby the middle preferably coincides with the middle of the length of the table and the ram of the press brake or the bending machine.

In order to better explain the characteristics of the invention, the following preferred embodiments of an automated press brake or bending machine according to the invention are described as an example only without being limitative in any way, as well as a method for bending metal sheet material according to the invention, with reference to the accompanying figures, in which.

Figure 35:
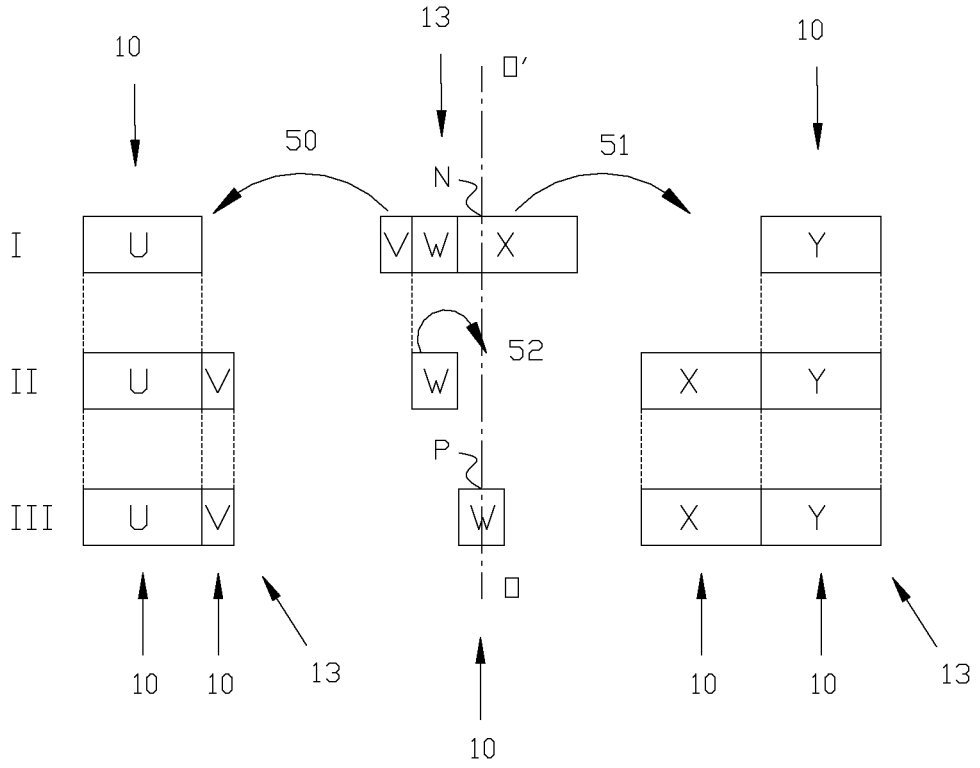
Figure 36:
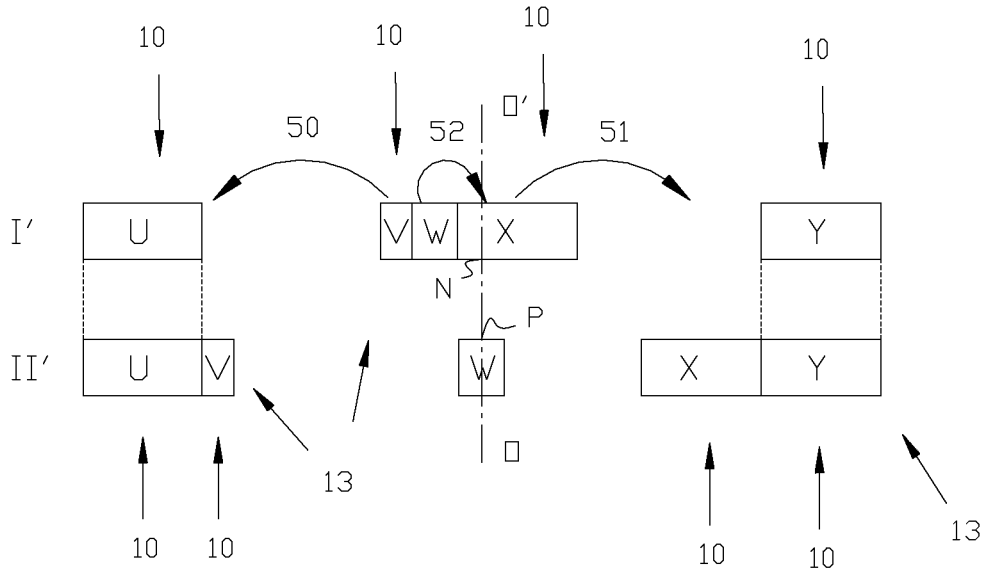
Figure 37:
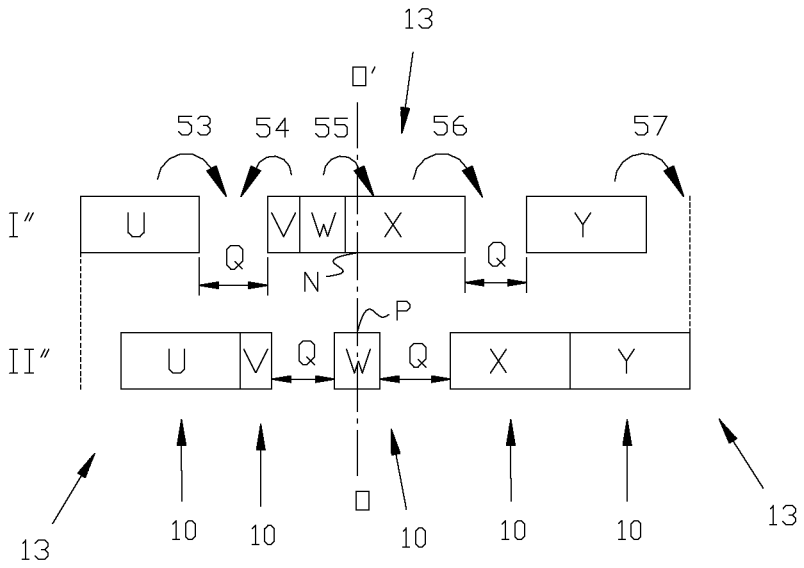
Figure 38:
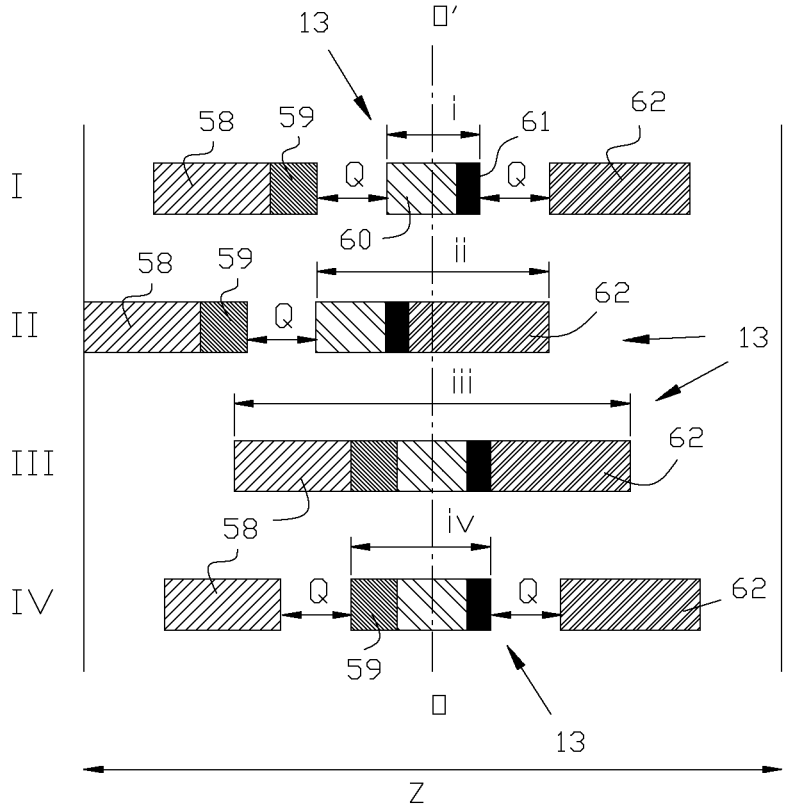
Figure 39:
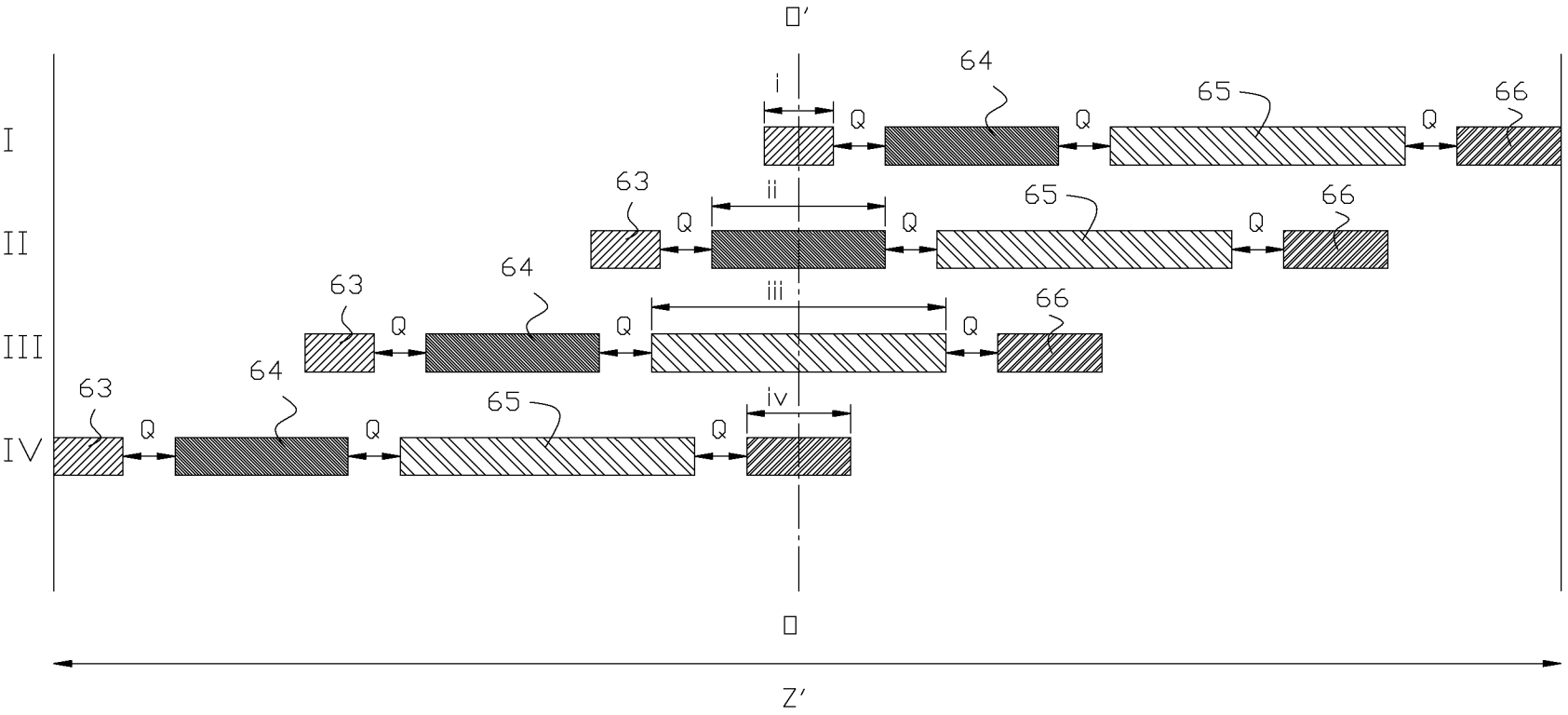

FIG. 35 schematically illustrates how, with a simple version of an automated press brake or bending machine according to the invention, a first assembled set of tool segments can be rearranged into a second assembled set of tool segments in three steps;

FIG. 36 schematically illustrates how the same rearrangement as in FIG. 35, with a more sophisticated version of an automated press brake or bending machine according to the invention, can be done in merely two steps;

FIG. 37 schematically illustrates how, with an even more sophisticated version of an automated press brake or bending machine according to the invention, a similar rearrangement can be done in an even more dynamic way so as to always keep the tool segments at a minimal distance from one another;

FIG. 38 schematically represents four situations, each time for bending a work piece over another length, whereby tool segments are grouped into an assembled set of tool elements in a way that is typical in an automated press brake or bending machine according to the invention; and, FIG. 39 illustrates how similar configurations are obtained as in FIG. 38 in a way that is typical for a known automated press brake or bending machine.

Figure 1:
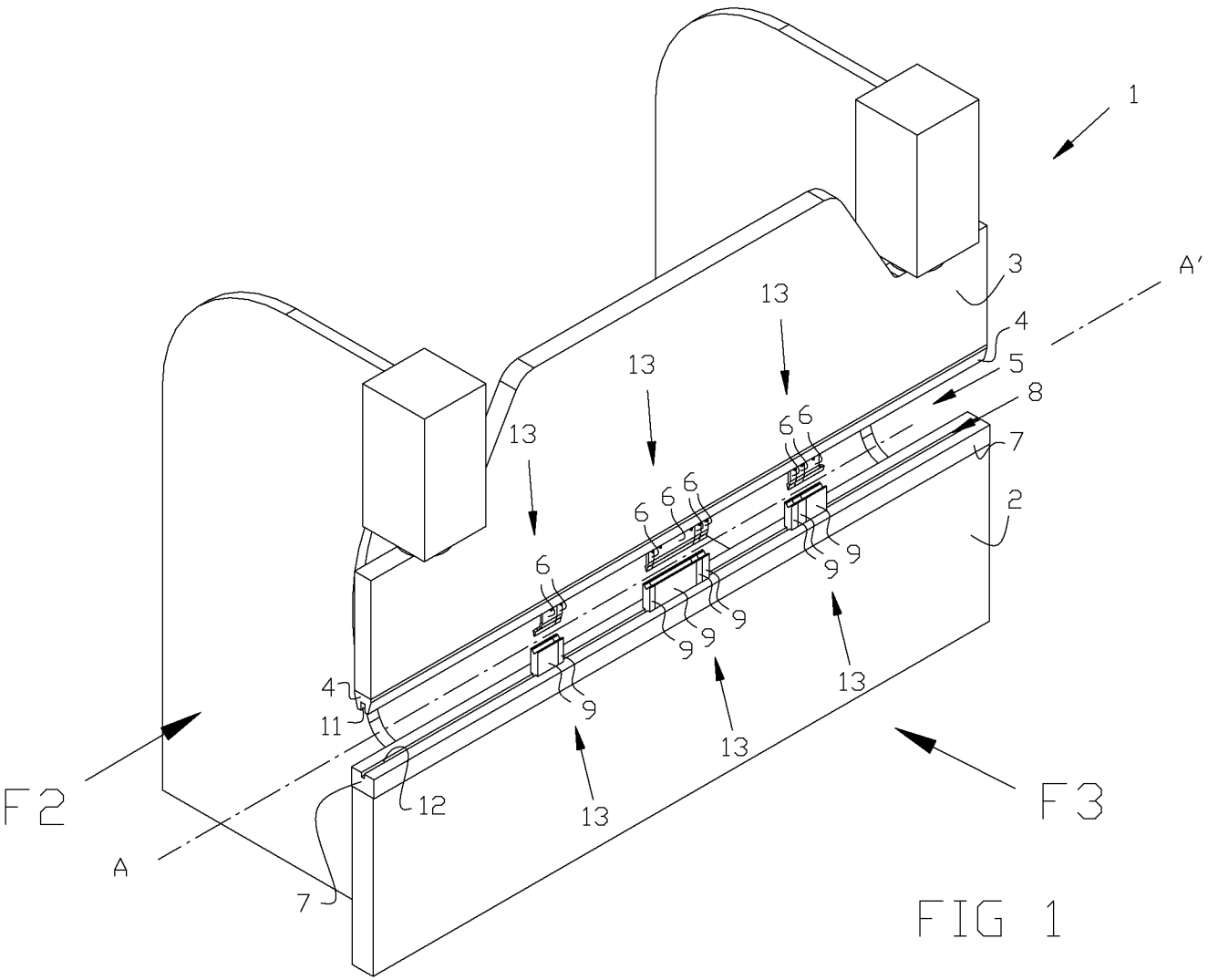
FIG. 1 shows a view in perspective of an automated press brake or bending machine according to the invention.
Figure 2:
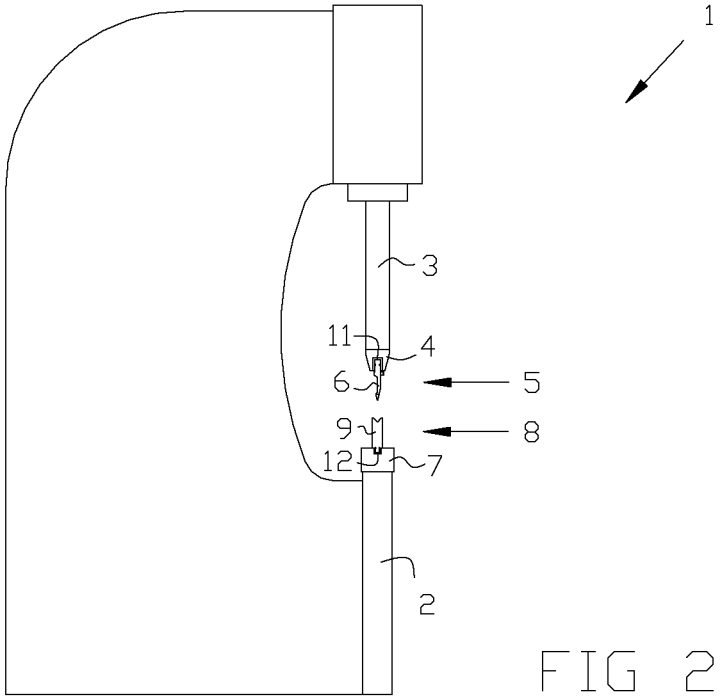
FIGS. 2 and 3 show a side view and a front view respectively on the automated press brake or bending machine according to the invention from FIG. 1, more specifically according to arrows F2 and F3.
Figure 3:
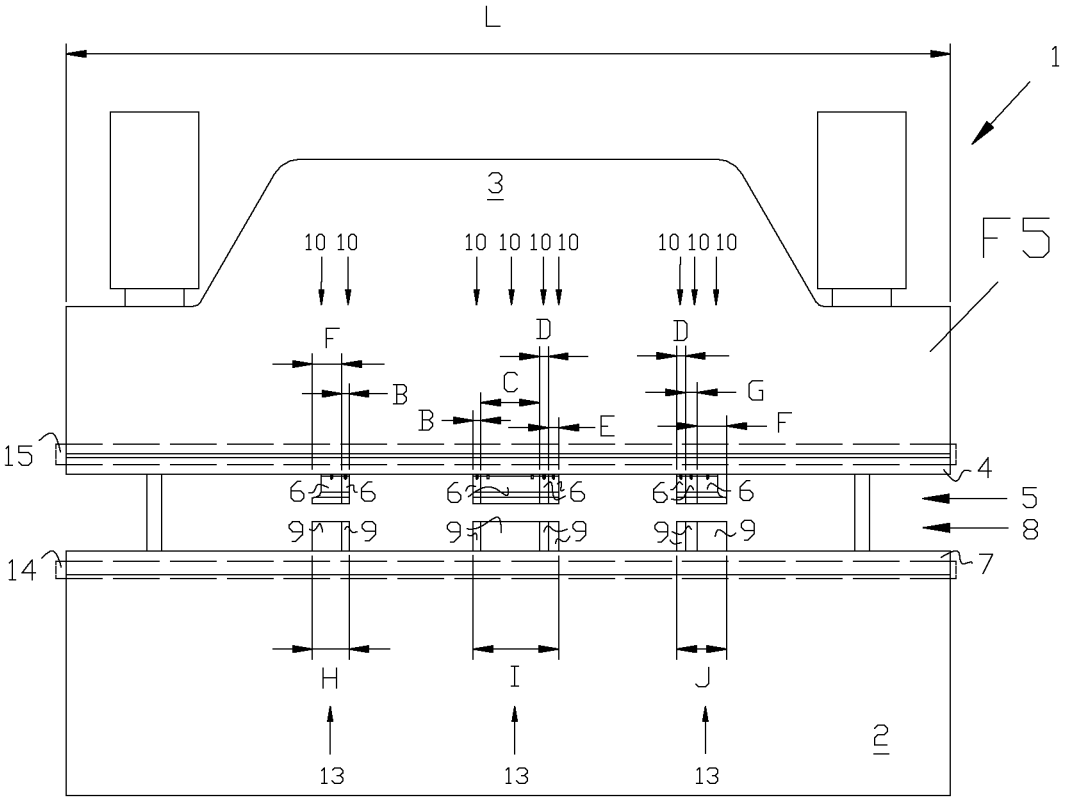

The automated press brake or bending machine 1 according to the invention as represented in FIGS. 1 to 3 is designed for bending metal sheet material and is provided to this end with a statically arranged table 2 and a beam or ram 3 which can move up and down in relation to this table 2.

The movable beam or ram 3 contains an upper tool holder 4 on which top tools 5 in the shape of one or several punches of folding knives 6 can be provided.

The table 2 is also provided with a lower tool holder 7 on which bottom tools 8 in the shape of one or several dies 9 can be provided.

The dies 9 generally consist of an element with a V-shaped groove whose opening angle, vertical depth and horizontal width differs as a function of the sheet thickness and the folding angle to be obtained.

Also dies 9 with a U-shaped groove are applied, typically for double-folding sheet material.

The punches or folding knives 6 may also have all kinds of shapes depending on the application, with a sharp or blunt tip which is either or not provided symmetrically, and so on.

Figure 12:
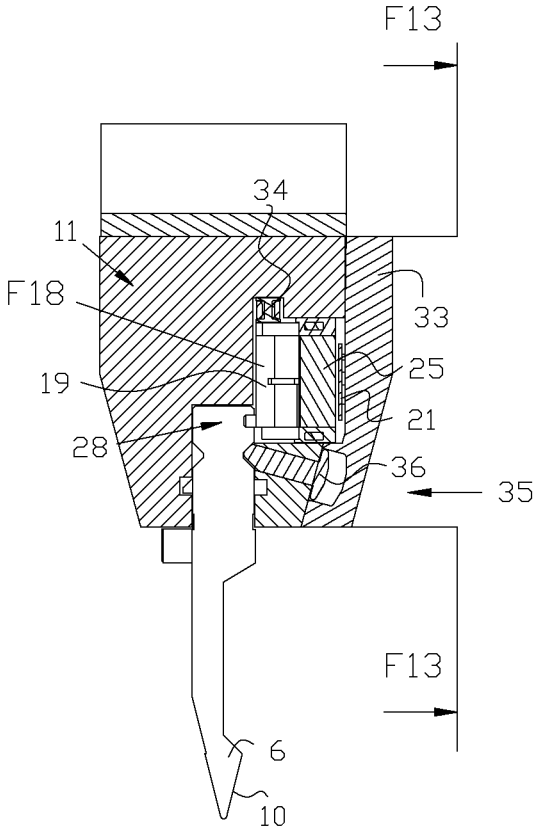
FIG. 12 shows a magnified section through the ram according to line XII-XII in FIG. 5.
Figure 13:
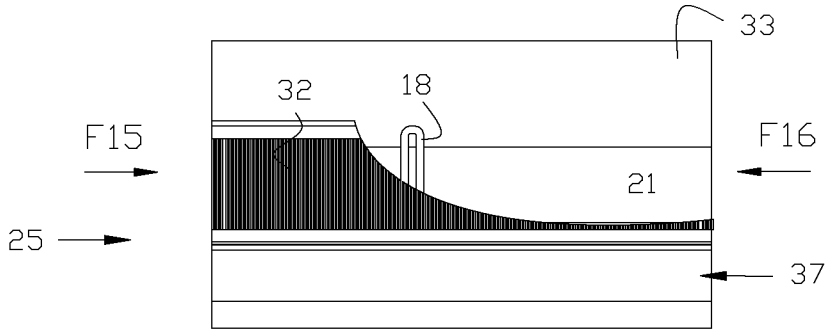
FIG. 13 shows a front view of the portion indicated by arrows F13 in FIGS. 8 and 12 to a larger scale.
Figure 14:
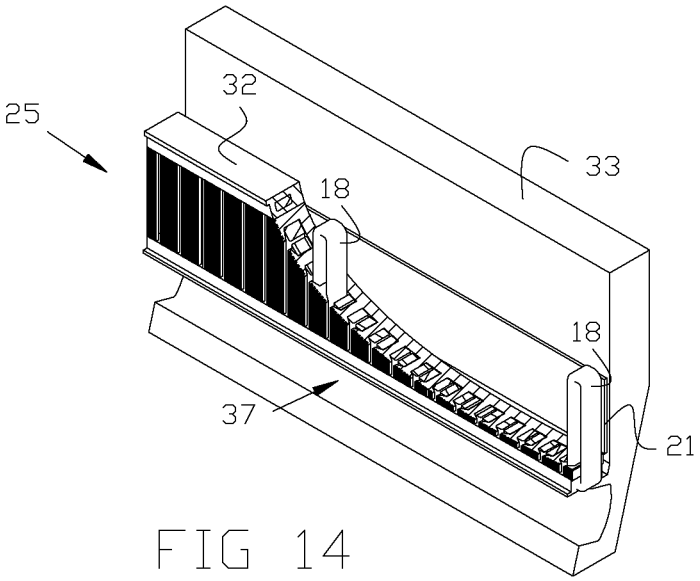
FIG. 14 shows the portion from FIG. 13 in perspective.
Figure 15:
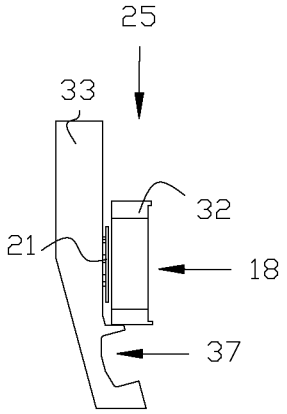
FIGS. 15 and 16 are side views according to arrows F15 and F16 in FIG. 13.
Figure 16:
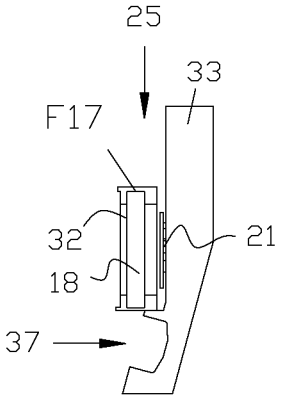

A possible shape of such a folding knife 6 is for example represented in more detail in FIG. 12.

The dies 9 and punches 6 are each formed of a tool segment 10 with a varying width B, C, D, E, F, G, etcetera, which can be moved to and fro according to the longitudinal direction AA' of the respective tool holder 4 or 7.

To this end, a groove 11 and a groove 12 respectively are provided in the upper tool holder 4 and in the lower tool holder 7, extending over the length L of the press brake or bending machine 1 and in which the tool segments 10 can be provided such that they slide back and forth.

The aim hereby is to group several tool segments 10 together into an assembled set 13 of tool segments 10 having a width H, I, J, etcetera, in accordance with the required fold length for making a fold in the work piece to be processed.

To this aim, the automated press brake or bending machine 1 is provided with driving means 14 and 15 for moving and arranging the bottom tool 8 and the top tool 5 respectively on the tool holder concerned, the lower tool holder 7 and the upper tool holder 4 respectively.

Figure 4:
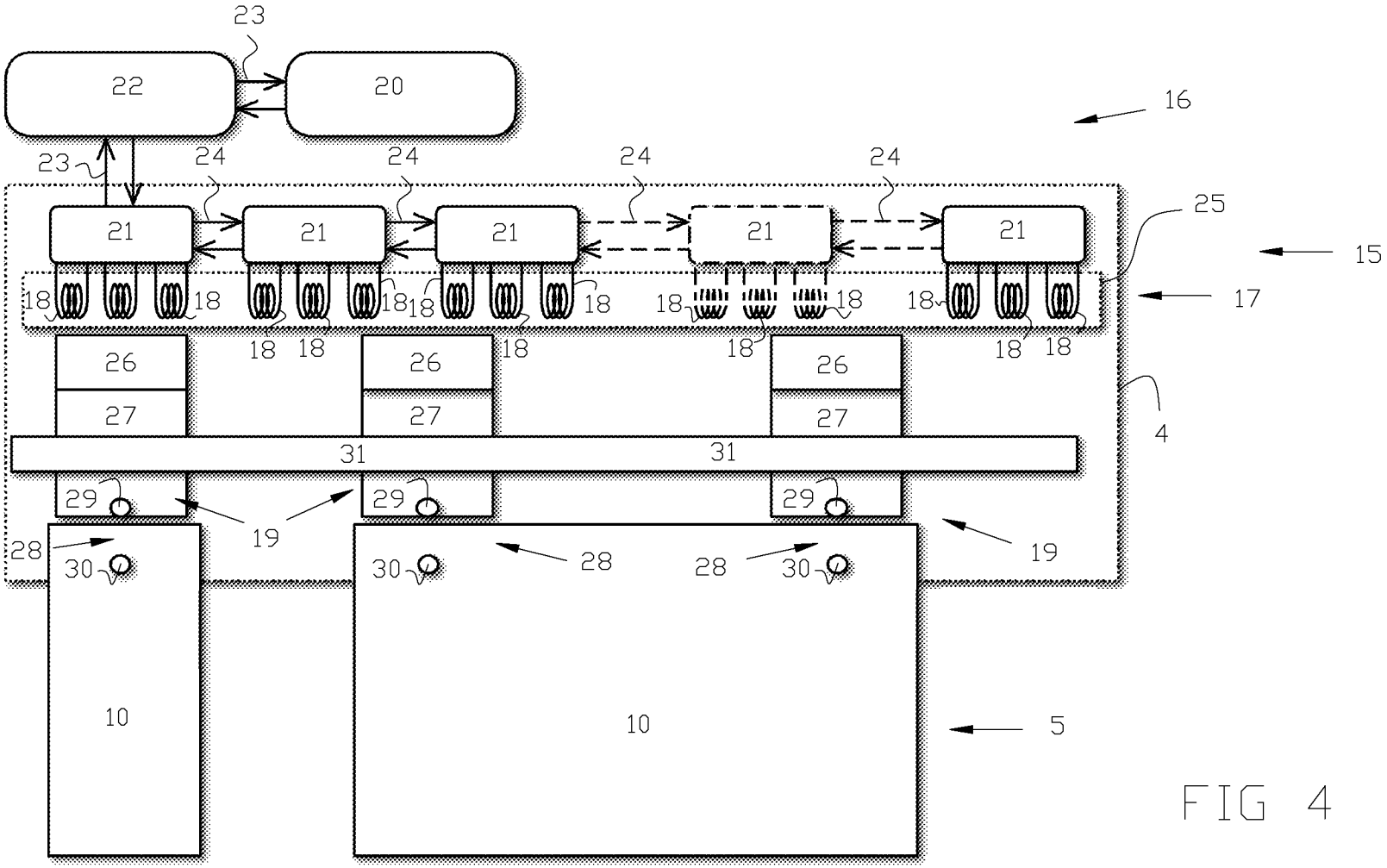
FIG. 4 represents a functional diagram showing different parts of the press brake or bending machine from FIG. 1.
Figure 5:
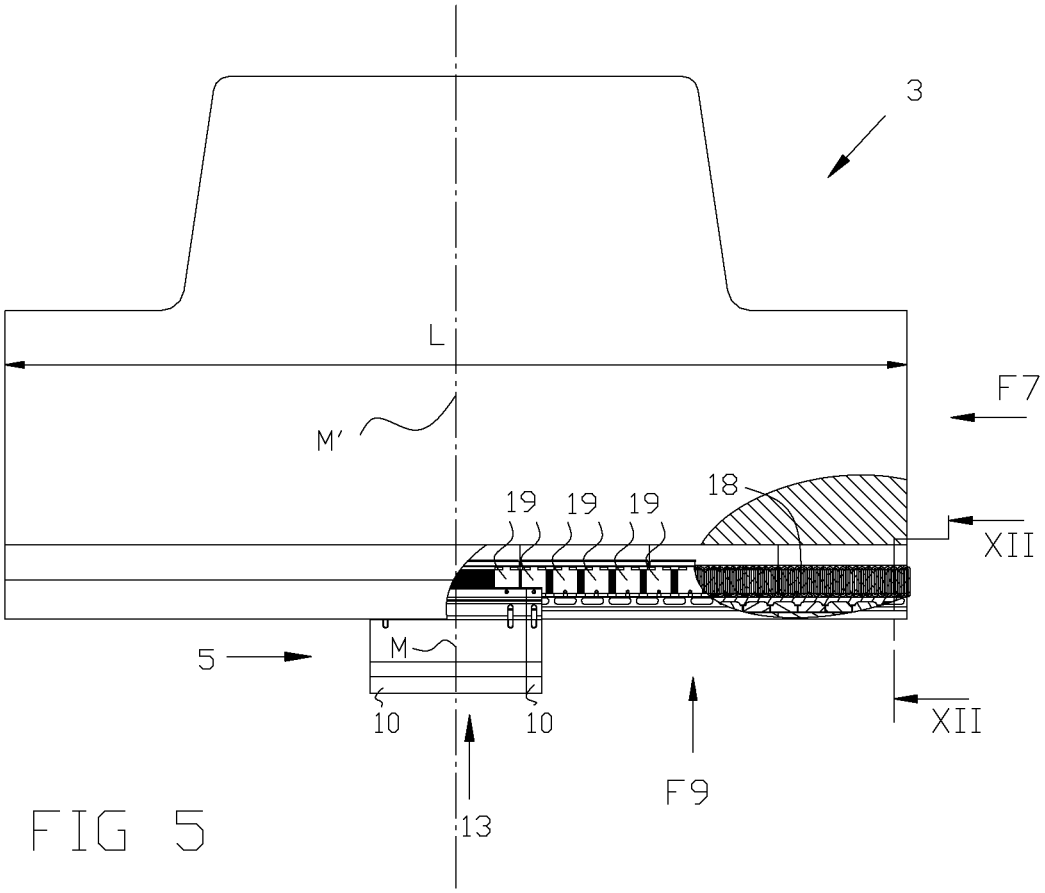
FIG. 5 shows a front view of the ram of the press brake or bending machine to a larger scale, indicated by F5 in FIG. 3, wherein a portion has been removed however, for a clear illustration of inner portions.
Figure 6:
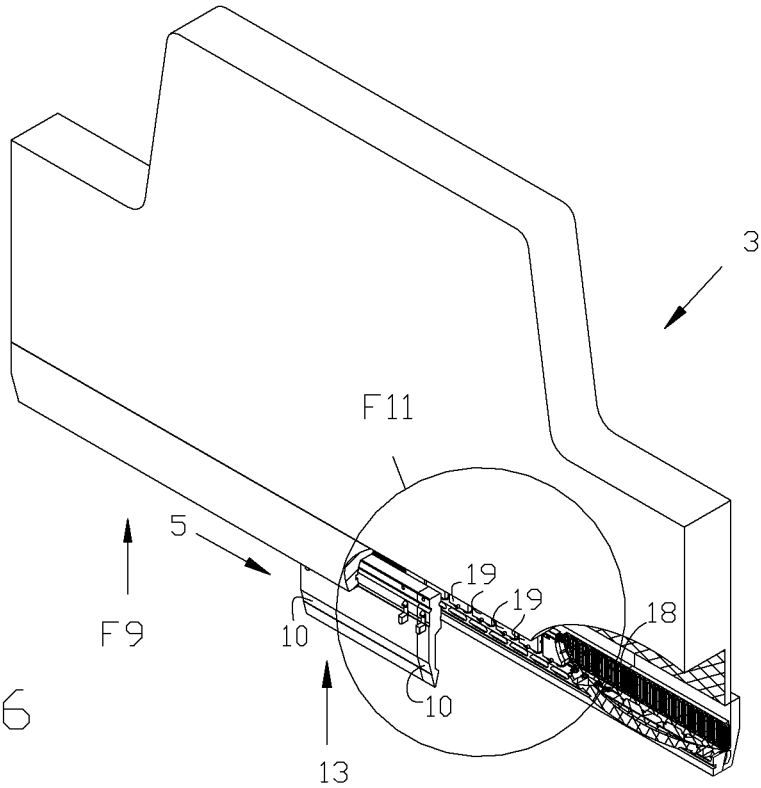
FIG. 6 shows the ram from FIG. 5 in perspective.
Figure 7:
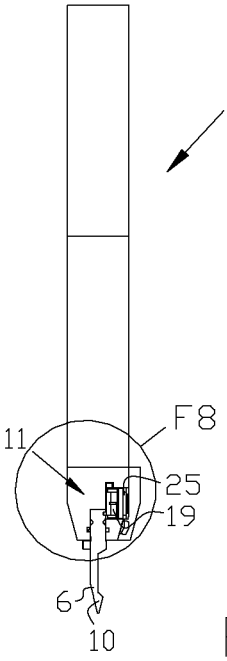
FIG. 7 is a side view on the ram according to arrow F7 in FIG. 5.

The automated press brake or bending machine 1 is further provided with a control unit 16 for controlling the driving means 14 and 15 which, apart from other elements of the press brake or bending machine 1, are more schematically represented in FIG. 4.

Characteristic of the invention is that the driving means 14 and 15 are integrated in the table 2 or movable beam 3.

In a preferred embodiment, the driving means 14 and 15 according to the invention are integrated in the upper tool holder 4 and lower tool holder 7.

In the embodiment of an automated press brake 1 or bending machine 1 as represented in FIGS. 1 to 22, the driving means 14 and 15 consist of one or several linear motors 17 which are each formed of a series of electromagnets 18 which are integrated in one of the tool holders, more specifically the lower tool holder 7 or the upper tool holder 4.

FIG. 4 schematically represents a possible configuration for the upper tool holder 4.

The electromagnets 18 each consist of an electric winding 18, they are fixedly arranged on the tool holder 7 and placed successively along the entire length L of this tool holder 4.

This is advantageous in that, for the electrical connection of the electromagnets 18, only a minimum of electric wiring is required, whereby little or no use should be made of the moving parts for this connection.

The electromagnets 18 are hereby individually controllable.

The linear motor 17 further contains controlled elements 19 formed of elements which are mainly made of metal.

The magnetic field of consecutive electromagnets 18 is hereby each time reversed by the control unit 16 in such a way that a magnetic force is always applied on a controlled element 19, propelling the controlled element along the linear path formed by the successive electromagnets 18.

The use of such a linear motor 17 offers a major advantage in that, with a single set of electromagnets 18, several controlled elements 19 can be simultaneously controlled, provided a suitable control unit 16 is developed to that end.

In short, such a linear motor 17 which is such that several tool segments 10 can be simultaneously controlled with it so as to make said plurality of tool segments 10 undergo a linear movement independently from one another along the respective tool holder 4 or 7.

In the given schematic example of FIG. 4, the control unit 16 contains a central CNC control unit 20 which serves as an interface for the user.

This central CNC control unit 20 determines among others the position of the controlled elements 19 and controls the machine axles of the automated press brake or of the bending machine 1.

The control unit 16 also includes several drive units 21, consisting of an electronic circuit and which can each control a number of separate electromagnets 18.

At least one of the drive units 21 communicates with the central CNC control unit 20.

In the case of FIG. 4, the control unit 16 is hereby provided with an intermediate unit 22 which handles the communication between one of the drive units 21 (most to the left in FIG. 4) and the CNC control unit 20 with the help of communication means 23.

Further, said plurality of drive units 21 is arranged in series, one after the other, along the entire length L of the press brake or the bending machine 1.

The drive units 21 are hereby provided with communication means 24 in order to be able to communicate with the adjacent drive units 21 of the sequence of drive units 21, placed in series, in view of a common control of the series of electromagnets 18 provided along the entire length L of the press brake or the bending machine 1.

Such a series 25 of electromagnets 18 of a linear motor 17 is also called a "forcer" 25 in English, which could be defined as an excitation device 25.

The drive units 21, just as the electromagnets 18, are fixedly arranged on the respective tool holder 4 or 7 and they drive the controlled elements 19 by an action of the generated magnetic forces on the energized side 26 of these controlled elements 19.

The energized side 26 of the controllable elements 19 must not be provided with electric energy, as a result of which they can move freely.

According to the invention, the drive units 21 may for example also be provided with measuring instruments for measuring the position of the controlled elements 19.

The controlled elements 19 can further be coupled to the tool segments 10 of the respective tool holder 4 or 7 with their connectable side 27.

To this end, the controlled elements 19 are provided with controlled coupling means 28 for coupling a tool segment 10, whereby a connecting pen 29 can be moved in or out of the respective controlled element 10.

The connecting pens 29 can cooperate with one or several connecting holes 30 provided in the tool segments 10.

In order to control the coupling means 28 of each controlled element 19, the tool holder 4 or 7 is also provided with a coupling control unit 31 or a coupling drive system 31.

The remaining FIGS. 5 to 22 represent a more realistic embodiment of a ram 3 and its parts of a press brake or bending machine 1 according to the invention, whereby two tool segments 10 are assembled to form a set 13 of tool segments 10 for bending a metal sheet material.

Figure 8:
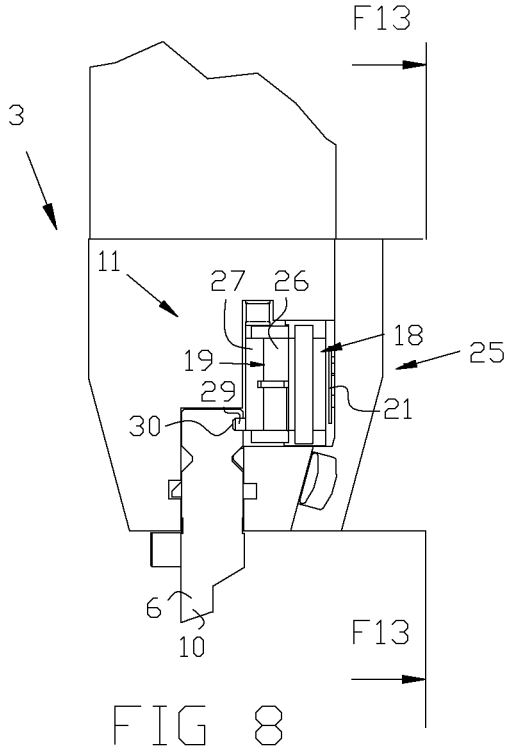
FIG. 8 is a magnified view of the portion indicated by F8 in FIG. 7.
Figure 9:
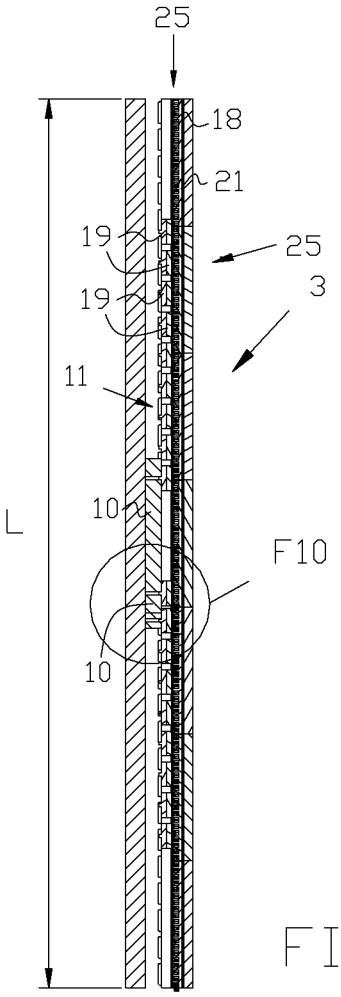
FIG. 9 is a bottom view of the ram according to arrow F9 in FIG. 5.
Figure 10:
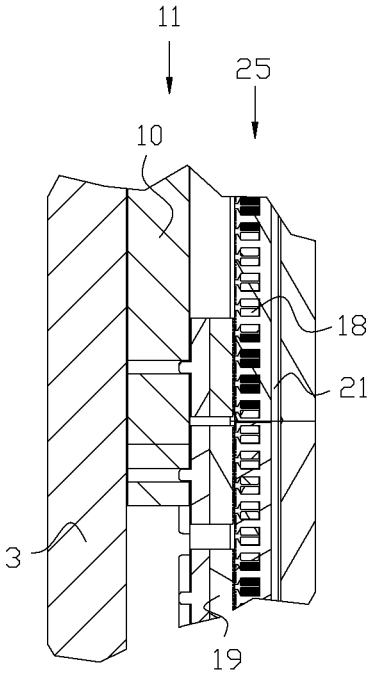
FIG. 10 is a magnified view of the portion indicated by F10 in FIG. 9.
Figure 11:
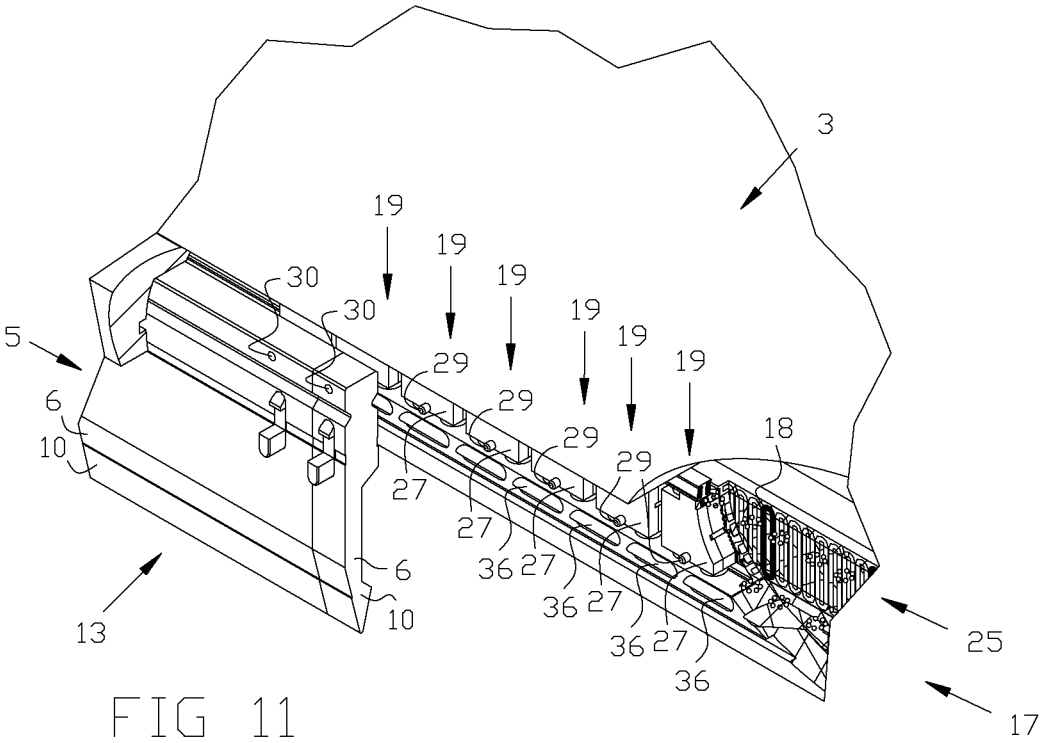
FIG. 11 is a magnified view of the portion indicated by F11 in FIG. 6.

As is represented in more detail in FIGS. 8, 11 and 12, the controlled elements 19 are designed for example as beam-shaped elements 19 which are directed towards the forcer 25 with their energized side and towards the tool segments 10 with their connectable side.

In the given example, the electromagnets or electric windings 18 are further provided with a core of laminated iron 32, which is clearly illustrated for example in FIGS. 13 to 16.

In other embodiments of a press brake or bending machine 1 according to the invention, it is not excluded, however, to use linear motors 17 of another type, such as for example a linear motor with ironless core, a linear variable reluctance motor, a linear motor with permanent magnet or a hybrid linear motor, more specifically a linear motor which is a combination of a linear variable reluctance motor and a linear motor with permanent magnet.

According to a preferred embodiment, a linear motor 17 of the press brake or the bending machine 1 is a hybrid, linear stepper motor 17.

Figure 17:
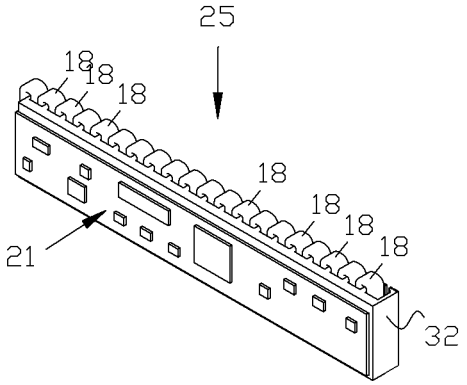
FIG. 17 shows the portion indicated by F17 in FIG. 16 in perspective.
Figure 18:
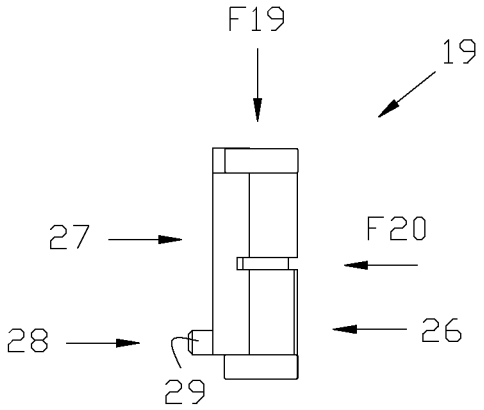
FIG. 18 shows the portion indicated by F18 in FIG. 12 to a larger scale.
Figure 19:
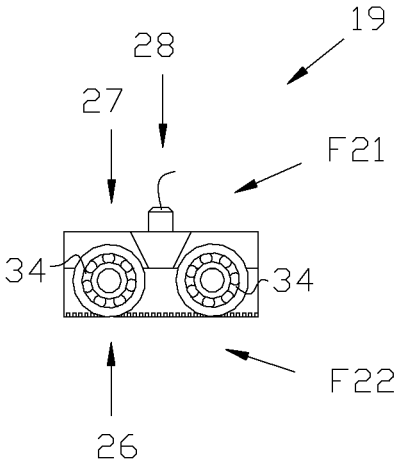
FIGS. 19 to 22 are views according to arrows F19 to F22 respectively in FIGS. 18 and 19.
Figure 20:
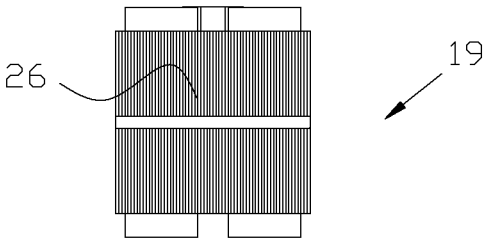
Figure 21:
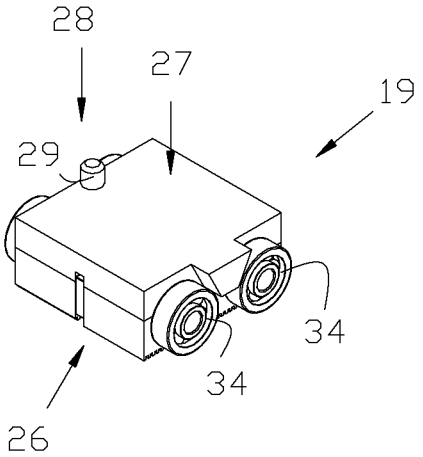
Figure 22:
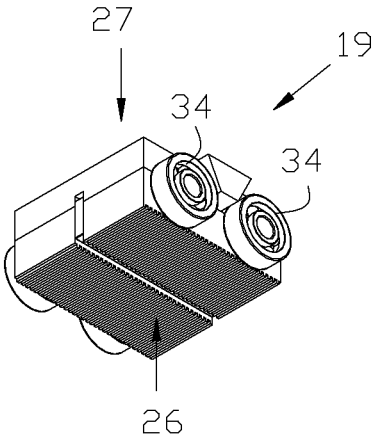
Figure 23:
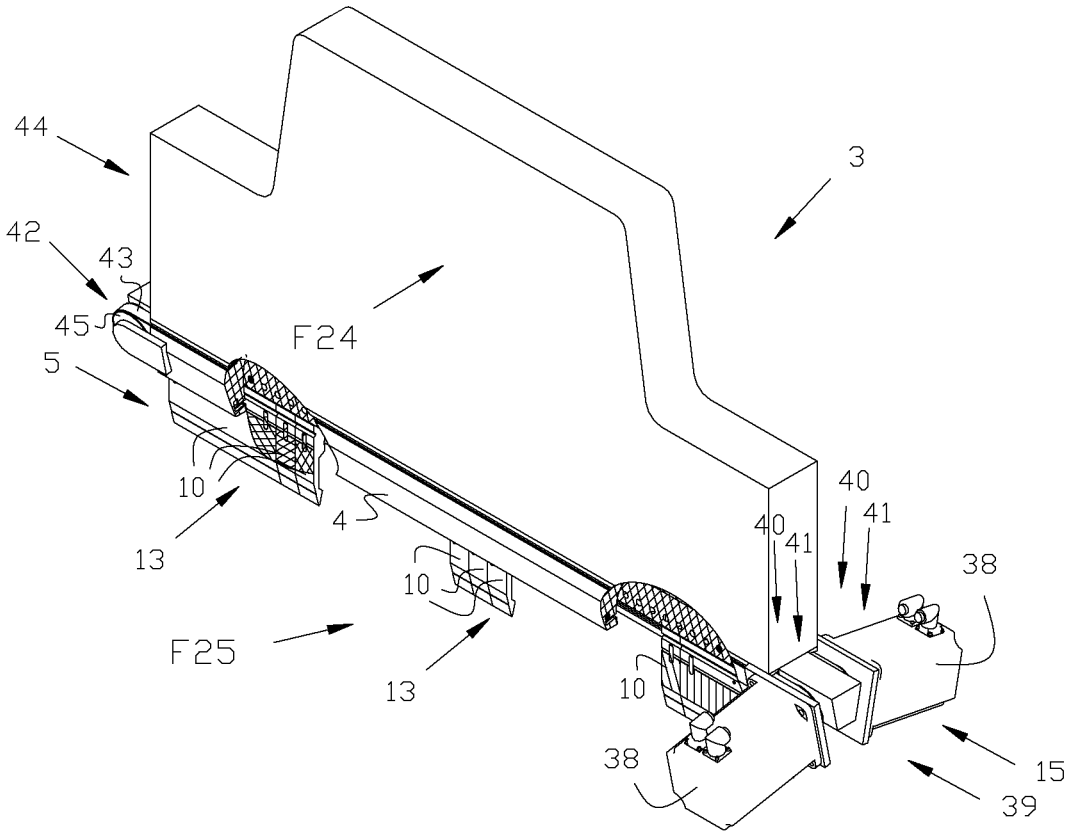
FIG. 23 shows a ram or movable beam of another embodiment of an automated press brake or bending machine according to the invention, seen in perspective.
Figure 24:
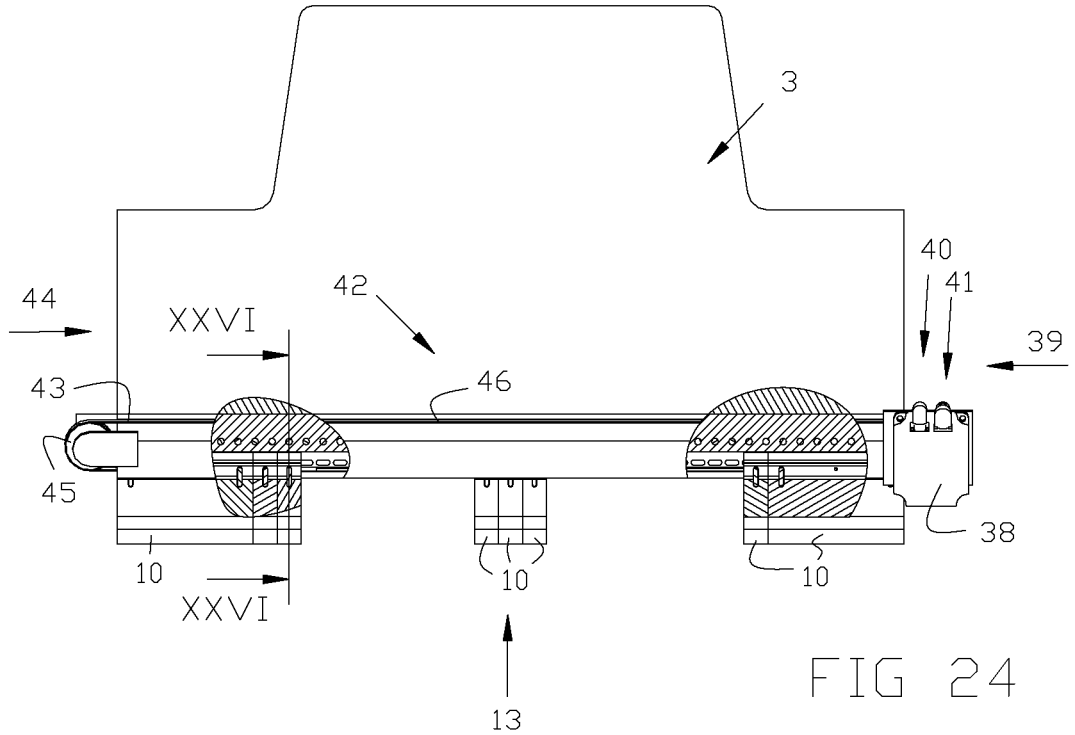
FIG. 24 is a front view of the ram in FIG. 23.
Figure 25:
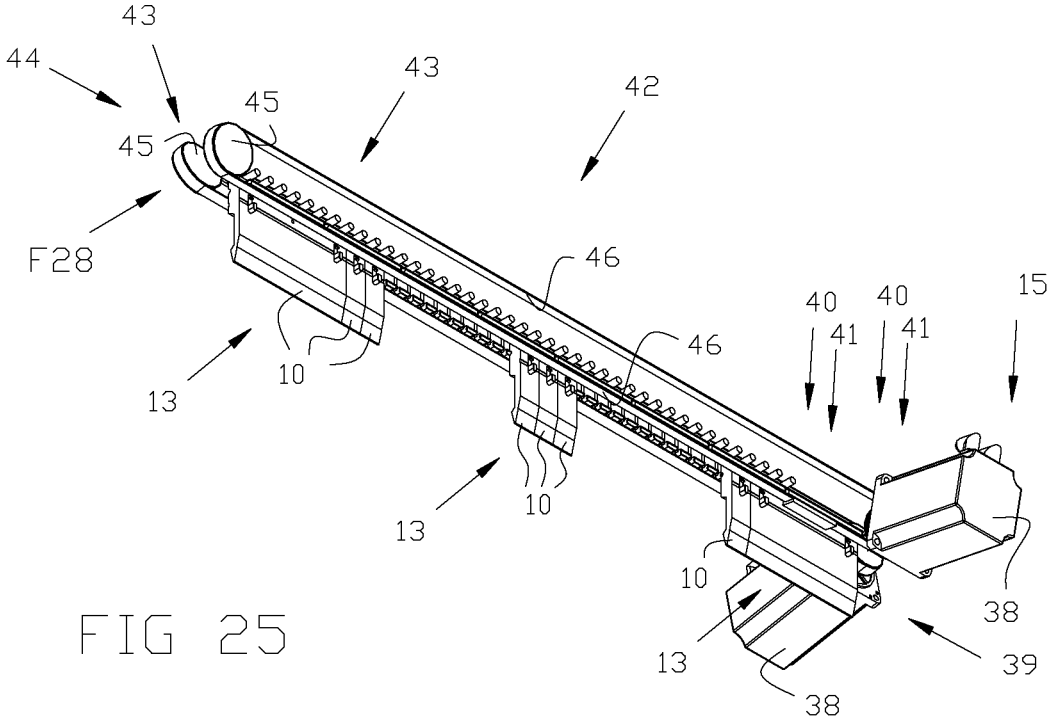
FIG. 25 shows a view in perspective according to arrow F25 of the upper tool holder which is part of the ram in FIG. 23.

The drive units 21, an example of which is represented in more detail in FIG. 17, are provided between a back wall 33 of the upper tool holder 4 and the electromagnets 18 with iron core 32.

Thus, everything can be made compact and the electronic components can easily give off their heat to the upper tool holder 4.

In order to obtain a smooth movement of the controlled elements 19 and the tool segments 10 in the groove 11, as frictionless as possible, the controlled elements 29 in the given example (illustrated in detail in FIGS. 18 to 22) are provided with a bearing 34 with which they can be moved in the tool holder 7 and over the series of electromagnets 18.

The controlled elements 19 are moved forward by the magnetic force originating from the electromagnets 18.

With the coupling means 28, a tool segment 10 can be coupled to one or several of these controlled elements 19 so as to be moved along the tool holder 7 or 4 into the desired position.

Once there, the tool segment 10 can be disengaged again from the respective controlled element 19 or from the respective controlled elements 19 by moving the corresponding connecting pens 29 out of the connecting holes 30.

The invention is not restricted to a coupling system with a pin and hole. Other coupling systems which make use of permanent magnets or electromagnets or other methods are not excluded either from the invention.

In order to obtain a good anchoring or fixation and correct positioning of the tool segments 10 in the tool holder 4 or 7, which is of course important during the folding operation both for safety and for accurate finishing, the tool holder 4 or 7 is provided with retaining means 35 with which a tool segment 10 can be clamped in the tool holder 4 or 7.

In the given embodiment, the retaining means 35 are formed of locking pins 36 with which a tool segment 10 can be locked in the tool holder 4 or 7.

The locking pins 36, usually hydraulic or pneumatic, are hereby pushed towards the tool segments 10 by putting a flexible conduit in the groove 37 in the back wall 33 under pressure, which are thus clamped and fixed.

Figure 26:
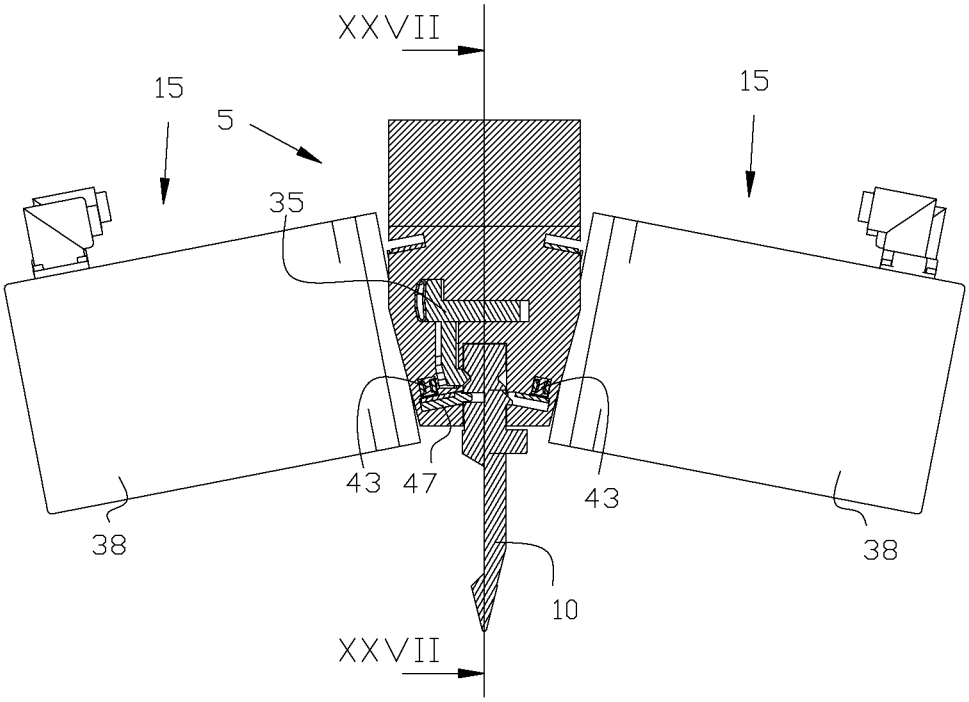
FIG. 26 shows a section to a larger scale according to section XXVI-XXVI in FIG. 24.
Figure 27:
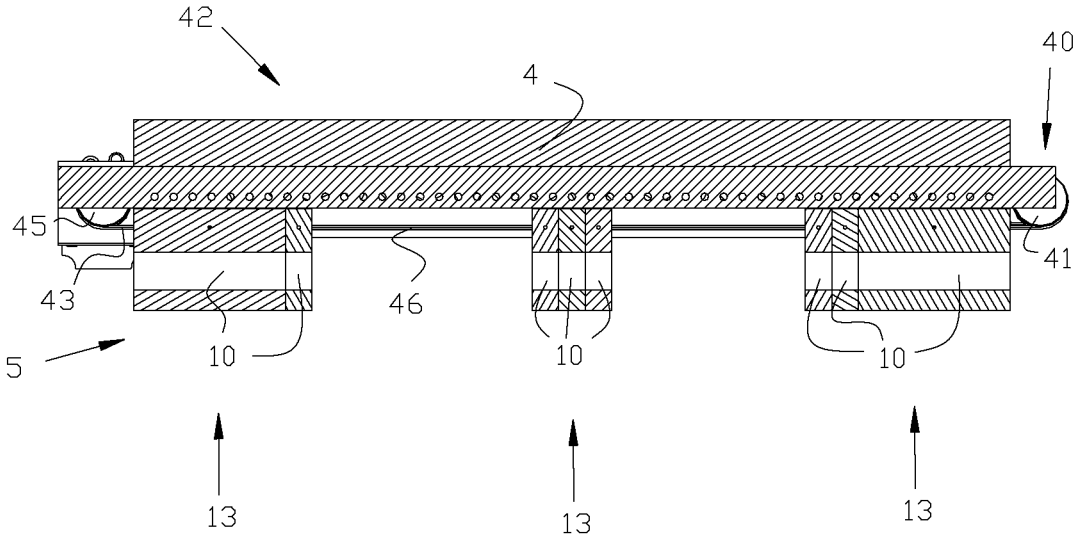
FIG. 27 shows a section through the upper tool holder represented in FIG. 25 according to section XXVII-XXVII indicated in FIG. 26.
Figure 28:
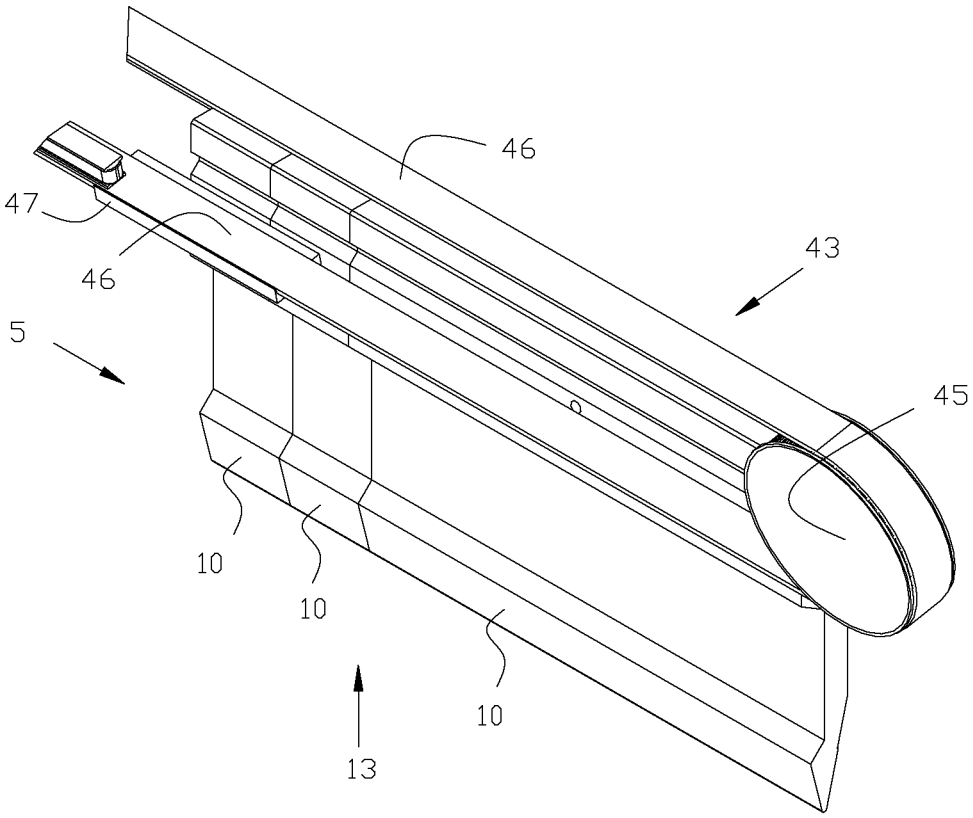
FIG. 28 is a magnified view of the portion indicated by F28 in FIG. 25.
Figure 29:
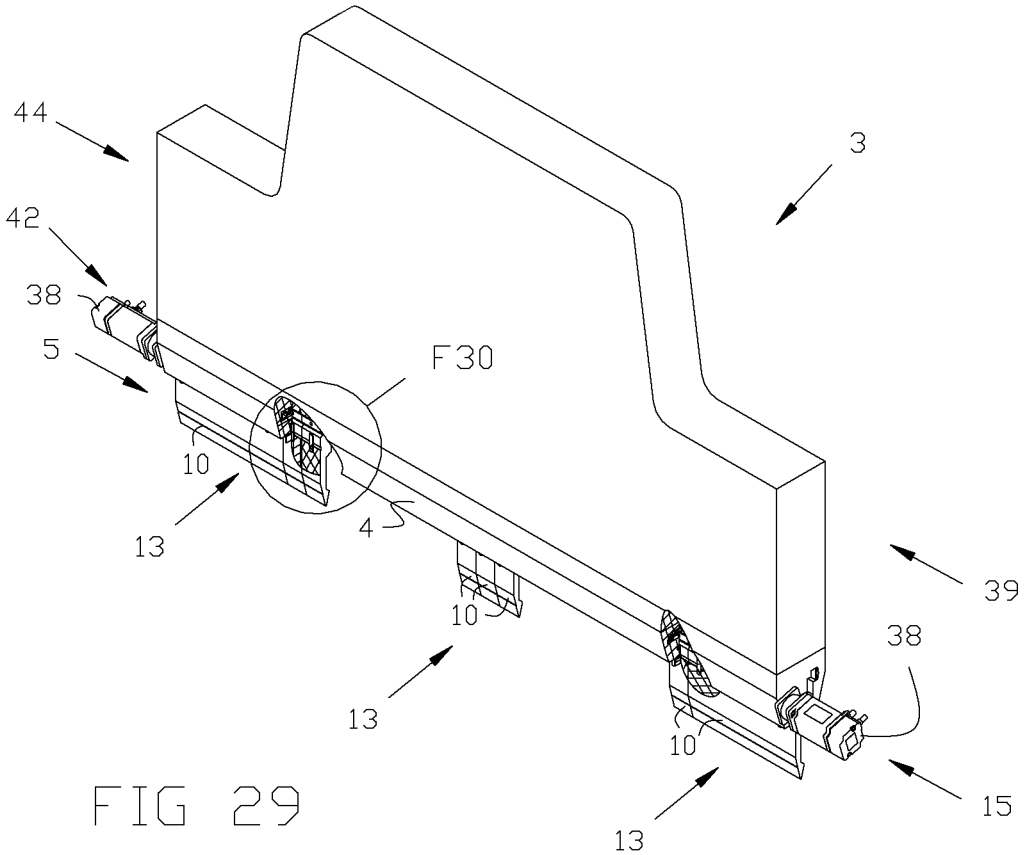
FIG. 29 shows a ram or movable beam of yet another embodiment of an automated press brake or bending machine according to the invention, seen in perspective.
Figure 30:
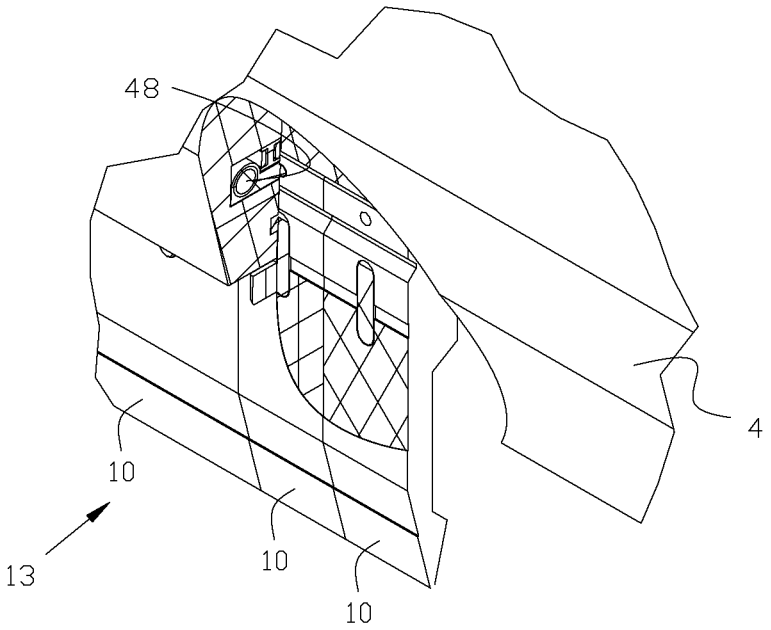
FIG. 30 is a magnified view of the portion indicated by F30 in FIG. 29.
Figure 31:
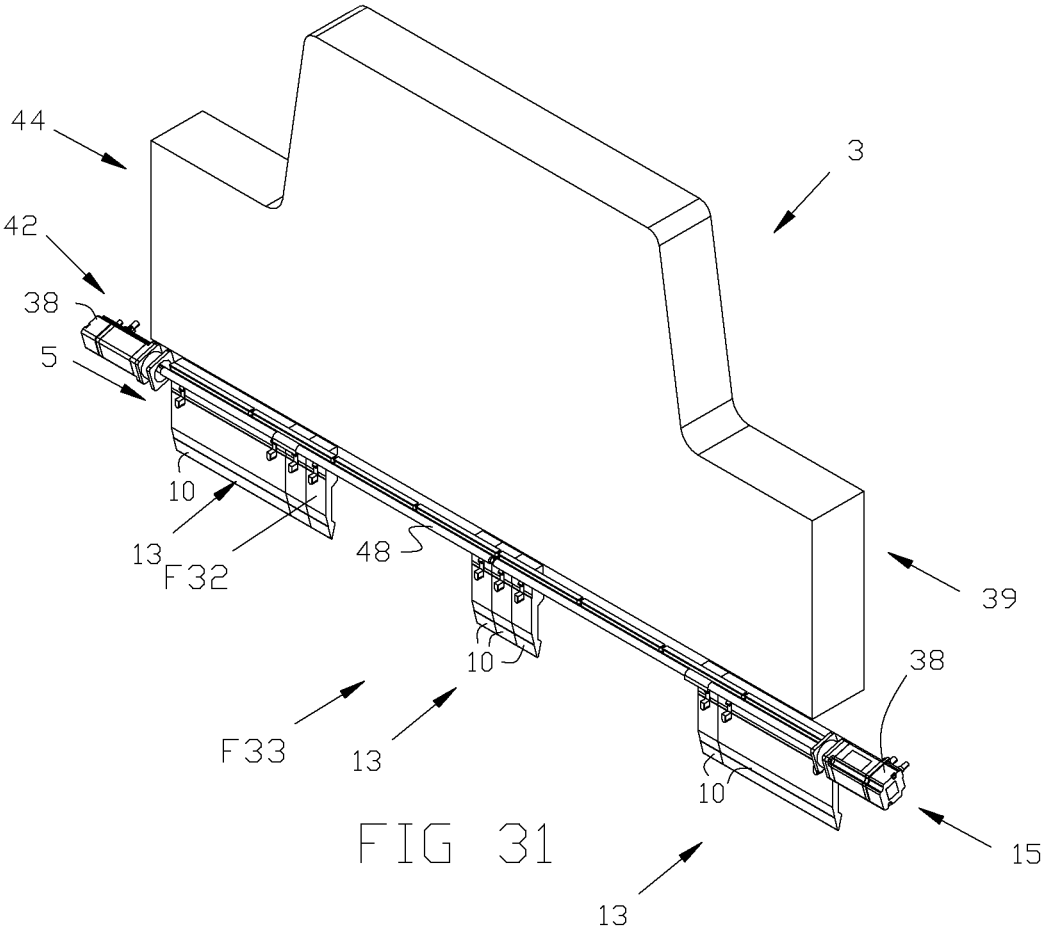
FIG. 31 shows the ram or movable beam from FIG. 29 in perspective, whereby the front portions have been omitted.
Figure 32:
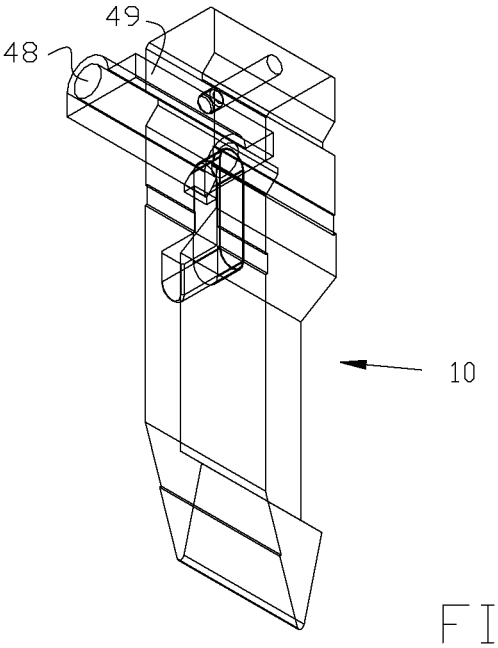
FIG. 32 shows the portion indicated by F32 in FIG. 31 as magnified and in perspective.
Figure 33:
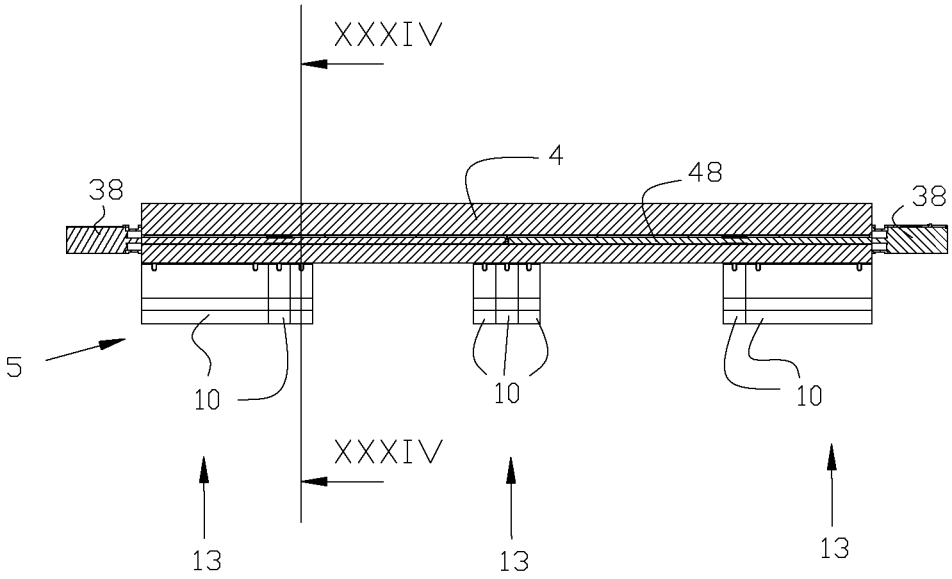
FIG. 33 shows a front view according to arrow F33 of the portion of the upper tool holder of the ram or movable beam represented in FIG. 31; and, FIG. 34 shows an enlarged cross-cut according to section XXXIV-XXXIV indicated in FIG. 33.
Figure 34:
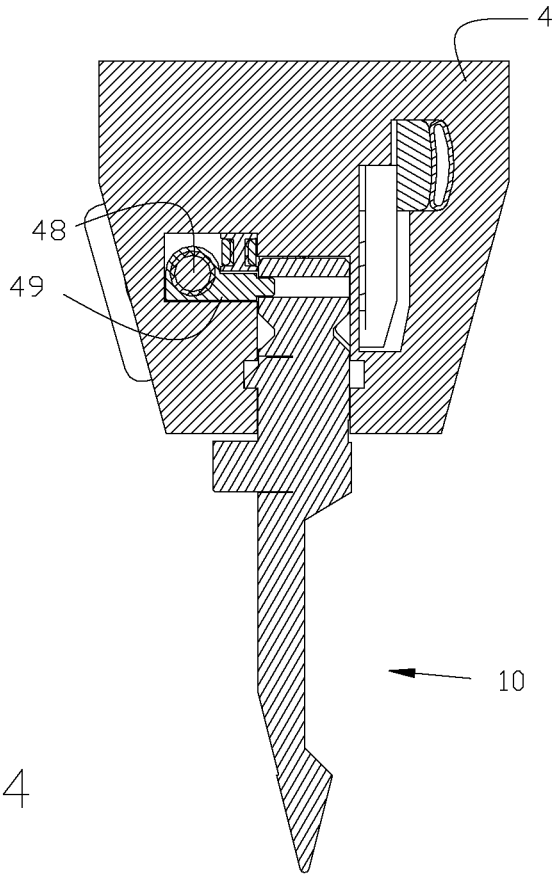

Such a flexible conduit is represented in FIGS. 26 and 34 and is not illustrated in FIG. 12.

Thanks to the integrated design of the drives 14 and 15, the control unit 16 can be made as a dynamic control unit 16 with which the tool segments 10, in between successive folding operations without any noticeable interruption in the bending process, can be arranged into an assembled set 13 of tool segments 10 whose middle M is centred in the middle M' of the length L of the table 2 and the ram 3.

In a variant of this embodiment, an energized side 26 is directly attached to every tool segment 10 or incorporated therein, such that the same result is obtained and such that the connecting pen 29, the connecting hole 30 and the coupling system can be omitted.

Thus is obtained a very efficient press brake 1 or bending machine 1, as a result of which the objectives of the invention as explained in the introduction are achieved.

FIGS. 23 to 28 represent another embodiment of an automated press brake or bending machine 1 according to the invention.

On the one hand, the driving means 14 and 15 (of which only the driving means 15 are represented in the figures) are integrated again in the table 2 and ram 3 in this embodiment, such that the tool segments 10 can still be moved in a fast and efficient manner over the tool holder concerned, more specifically either the upper tool holder 4 or the lower tool holder 7.

On the other hand, the driving means 14 and 15 have a completely different design.

Indeed, this time the driving means 14 and 15 contain electric motors 38 which are fixedly mounted on the table 2 (not illustrated) and the ram 3 (illustrated in the figures), depending on whether the driving means 14 are concerned, designed for moving and arranging the bottom tools 8 on the tool holder 7, or the driving means 15, designed for moving the top tools 5 on the upper tool holder 4.

The electric motors 38 may for example be servo motors, but other types of electric motors 38 are not excluded from the invention.

In the given example, the ram 3 is provided with a pair of such electric motors 38 which are both mounted on the same extreme side 39 of the ram 3.

Each electric motor 38 hereby has an output shaft 40 on which a pulley 41 is mounted, and of course it is intended that the electric motors 38 generate a rotating movement on their output shaft 40 with which the pulley 41 is driven.

The output shafts 40 of the pair of electric motors 38 of the ram 3 are directed towards one another and to the upper tool holder 4, such that they are arranged more or less symmetrically in relation to the plane of the ram 3.

In an analogous manner, the table 2 is provided with a similar pair of electric motors 38, which are not represented in the figures and which are designed for moving the bottom tool 8.

Every tool holder 4 and 7 further contains several controlled elements 19, just as in the preceding embodiment.

Further, every electric motor 38 is provided with transmission means 42 with which the rotating movement generated on the output shaft 40 of the respective electric motor 38 can be converted into a linear movement of a controlled element 19 along the respective tool holder, either the lower tool holder 7 or the upper tool holder 4.

The controlled elements 19 can also be coupled to the tool segments 10 of the respective tool holder 4 or 7, just as in the preceding embodiment.

In the embodiment of an automated press brake or bending machine 1 according to the invention, represented in FIGS. 23 to 28, the transmission means 42 are formed of a belt 43 which is driven by the respective electric motor 38 of the drive 14 or 15.

The belt 43 on the side 39 of the ram 3 at the location of the electric motor 38 is hereby carried over the pulley 41 on the other side 44 of the ram 3 over a rotatably arranged second pulley 45, such that the belt 43 can perform a rotating movement.

Two linear portions 46 of the belt 43 hereby always extend along the respective tool holder 4 or 7.

In the given embodiment of FIGS. 23 to 28, the controlled elements 19 consist of a number of carriers 47 with which the belt 43 can be coupled to a tool segment 10.

For fixing a tool segment 10 on a respective tool holder 4 or 7, retaining means 35 are still provided, just as in the preceding embodiment.

In analogous embodiments it is not excluded, of course, to use a cable or chain or the like instead of a belt 43, and a roller or gear wheel or the like instead of a pulley 41, depending on the application.

An advantage of this embodiment of an automated press brake or bending machine 1 according to this embodiment is that it is made with fairly conventional devices, compared to the more sophisticated embodiment with linear motors 17 and CNC-control unit 20.

A disadvantage of this embodiment, however, is that the electric motors 38 and belts 43 occupy much space, as a result of which it is impossible to integrate many of that type of driving means 14 or 15 in one and the same tool holder 4 or 7 due to lack of space, restricting the number of movements of tool segments 10 that can be carried out simultaneously.

An advantage of this embodiment of an automated press brake or bending machine 1 according to the invention, compared to the known automated bending machines or press brakes, is that the driving means 14 and 15 are integrated in the tool holder 4 or 7 or at least in the respective ram 3 or table 2, so that coupling and uncoupling the tool segments 10 and moving them can be done during the movement of the ram 3 or table 2.

As a result, the assembly of a new assembled set 13 of tool segments 10, intended for a subsequent folding operation, can start right after the execution of a preceding folding operation and within the time that is required for the upward and downward movement of the ram 3 or table 2 preceding the start of the next folding operation.

Another difference with the existing automated press brakes is that the electric motors 38 are statically positioned with respect to the respective tool holders 4 or 7.

Thus, there is no need for movable wiring, as is the case with the known automated press brakes which make use of gripping means which, in between folding operations, are placed in a parking zone.

Movable wiring is more vulnerable and takes a lot of space.

With an automated press brake 1 according to the invention, as represented in FIGS. 23 to 28, such a movable wiring is not required, which makes the whole more limited in size, especially in the area where the tool segments 10 need to be moved.

Besides, the limited size of the driving means 14 and 15 is a reason why the driving means 14 and 15 in this embodiment can be integrated in the ram 3 or table 2 or in the respective tool holder 4 or 7.

FIGS. 29 to 34 represent another embodiment of an automated press brake or bending machine 1 according to the invention which, just as the preceding embodiment, is not equipped with linear motors 17 but with electric motors 38 mounted on one side 39 of the ram 3.

The transmission means 42 are shaped differently than in the preceding embodiment, however.

Indeed, in this case the transmission means 42 are formed of a threaded spindle 48 which is driven by an above-mentioned electric motor 38 of the drive 14 or 15.

The electric motors 38 and threaded spindles 48 are mounted crosswise in this case, with a first electric motor 38 on the side 39 of the ram 3 and with a second electric motor 38 on the opposite side 44 of said ram 3.

Over this threaded spindle 48 is provided a displacement nut 49 which is connected or can be coupled to one or several of the controlled elements 19 or the tool segments 10.

Such an embodiment also makes it possible to integrate the driving means 14 and 15 in the ram 3, the table 2 or in the respective tool holder 4 or 7, such that the same advantages in terms of speed of movement of tool segments 10 and the assembly of sets 13 of tool segments 10 are obtained.

Again, this makes it possible to reconfigure the sets 13 in between two folding operations.

Of course, this embodiment is also less complicated than the first one, but just as with the preceding embodiment it is not possible to simultaneously control many tool segments 10 either.

FIG. 35 shows in more detail how different assembled sets 13 of tool segments 10 can be formed with an automated press brake or bending machine 1 according to the invention in an embodiment wherein the driving means 14 or 15 contain for example two electric motors, such as for example in the above-discussed embodiments of FIGS. 23 to 33.

The top part I of FIG. 35 schematically represents tool segments 10 provided for example on the upper tool holder 4.

Five tool segments 10 are represented by way of example, each having another length, which have been individually numbered with the letters U, V, W, X and Y.

In the position shown in part I of FIG. 35, the tool segments 10 with mark V, W, and X are pushed together so as to form an assembled set 13 of tool segments 10.

The middle of this set 13 is centred on the centre line OO' of the automated press brake or bending machine 1, such that a good distribution of the forces in the machine is ensured.

The other tool segments 10 with marks U and Y are not in use in the position of part I of FIG. 35, and also, these tool segments 10 with marks U and Y are parked on either side of the automated press brake or bending machine 1.

After having performed a folding operation with the set 13 as represented in I, the aim in the given example of FIG. 35 is to perform an operation whereby only the tool segment with mark W is used.

This position is represented in part III of FIG. 35, wherein all tool segments 10 with marks U, V, X and Y are parked sideways and the middle P of the tool segment 10 with mark W is placed on the centre line OO'.

Since, in the aforementioned embodiment of the automated press brake or bending machine 1 according to the invention, only two electric motors 38 are provided, only two independent movements can be simultaneously made with tool segments 10.

This implies that, in order to get from the position represented in part I to the position represented in part III of FIG. 35, an intermediate step will be required in this case according to an intermediate position represented in part II of FIG. 35.

In order to achieve this intermediate position, the tool segment 10 with mark V was moved up against the tool segment 10 with mark U according to a linear movement indicated by arrow 50 so as to park it sideways in the bending machine 1.

Similarly, the tool segment 10 with mark X was moved up against the tool segment 10 with mark Y according to a linear movement indicated by arrow 51, also with the intention of parking it sideways in the bending machine 1 on the opposite side.

Since, in the intermediate position represented in part II of FIG. 35, the middle P of the tool segment 10 with mark W has not been centred yet on the centre line OO' of the machine, an additional shift of this element is required according to arrow 52, which movement can only be obtained in an additional step in this simple embodiment of an automated press brake or bending machine 1 according to the invention.

FIG. 36 illustrates how, in a single step, the same transition can be obtained whereby one goes from a configuration represented in part I' to a configuration represented in part II' by making use of a more sophisticated automated press brake or bending machine 1 according to the invention, which is provided for example with three or more motors or with a linear motor 17 of a type as discussed above with respect to FIG. 4.

Since, with such an automated press brake or bending machine 1 according to the invention, three or more tool segments 10 can be simultaneously controlled independently from one another for a movement as indicated by arrows 50-52, an intermediate step is indeed no longer required in this case.

Thus, it becomes possible to place the tool segments 10 even faster in another configuration than in the example illustrated in FIG. 35.

Naturally, an embodiment wherein use is made of only one single motor 17 for simultaneously moving tool segments 10 independently from one another is preferred because of its compact design, which also allows for an efficient control of the motor 17.

FIG. 37 illustrates a similar transition, more specifically from a position represented in part I" to a position represented in part II".

The position of part I" in FIG. 37 is similar to that in parts I and I' in FIGS. 35 and 36, but it is different in that between the central assembled set 13 of tool segments 10 with marks V, W and X and sideways parked tool segments 10 with marks U and Y, a minimal, safe distance Q is maintained, which was not the case in the preceding examples.

In the same way, also the centrally positioned tool segment 10 with mark W in part II' is maintained at a minimally required, safe intermediate distance Q from the sideways parked tool segments 10 with marks U, V and X and Y.

This is advantageous in that one always works safely, while the tool segments 10 are kept together as close as possible in a dynamic way.

This keeps the distances that each of the tool segments 10 must travel to a minimum, which contributes to the efficiency of the machine and the speed at which everything can be done.

Also, in a preferred embodiment, an automated press brake or bending machine 1 according to the invention will be provided with a control unit 16 controlling the driving means 14 or 15 in such a way that tool segments 10 are moved simultaneously and independently from one another over the respective tool holder 4 or 7 so as to form a central assembled set 13 to be used during a folding operation and sideways parked tool segments 10 which are not being used during a folding operation, whereby between the central assembled set 13 and the sideways parked tool segments 10 the same minimally required, safe intermediate distance Q is always maintained, and this for successive configurations of the central assembled set 13, irrespective of its length.

In order to allow for such a transition from a position represented in part I" to the position in part II" in FIG. 37, all five tool segments 10 with marks U, V, W, X and Y should be moved along the respective tool holder 4 or 5, according to a movement indicated by arrows 53 to 57 respectively.

This can be done in a single step with an automated press brake or bending machine 1 according to the invention provided with a linear motor 17 as discussed with reference to FIG. 4, since many tool segments 10 can be controlled simultaneously and independently from one another with such a motor 17.

Such an automated press brake or bending machine 1 according to the invention functions very dynamically, making it possible to put together different configurations in no time.

It is clear that the examples represented in FIGS. 35 to 37 were used for illustration purposes only and that the principles behind this illustrative explanation can be extended for example to larger numbers of tool segments 10, for example six tool segments 10 or more which can be moved simultaneously and independently from one another over their respective tool holder 4 or 7.

FIG. 38 schematically represents four positions I-IV of an automated press brake or bending machine 1 according to the invention, whereby tool segments 59 to 62 were each time put in another configuration, for example with methods as described with reference to FIG. 37, with the intention of being able to fold a work piece, over lengths i to iv respectively.

With the tool segments 59 to 62 is hereby each time formed an assembled set 13 of tool segments which is centred on the centre line OO' of the machine 1, whereby the length of such a set 13 each time corresponds to the required length i to iv and whereby a minimal safe intermediate distance Q with adjacent sets 13 or tool segments is maintained.

Naturally, the respective tool segments 59 to 62 have lengths which are smaller than the length i to iv of the set 13 of which they are part.

FIG. 39 also schematically represents four positions I to IV of a known automated press brake or bending machine—, for example of a type known from JP2004322199A.

Every position also allows to fold a work piece over a certain length, the same lengths i to iv respectively as in FIG. 38.

However, in the case of FIG. 39, use is made of tool segments 63 to 66 having lengths which correspond exactly to the lengths i to iv respectively.

The tool segments 63 to 66 are mutually separated from one another over a minimal, safe distance Q.

In each of the positions I to IV, one of the tool segments 63 to 66 is each time positioned with its middle on the centre line OO'.

To this end, the entire series of tool segments 63 to 66 is integrally shifted over the respective distance, whereby the mutual distance between the tool segments 63 to 66 remains the same.

It is clear that it must be possible to shift the entire series of tool segments 63 to 66 over a sufficiently large distance if there is any centring on the centre line OO'.

Consequently, such a known bending machine must be made with a width or length Z' which is very large and which may soon adopt unrealistic proportions.

This length Z' is many times greater than the length Z with which an automated press brake or bending machine 1 according to the invention should be made.

The invention is by no means restricted to the embodiments of a press brake 1 or bending machine 1 according to the invention described by way of example and illustrated in the figures; on the contrary, such press brakes 1 or bending machines 1 can be made in many different ways while still remaining within the scope of the invention.

Neither is the invention restricted to the method according to the invention for bending metal sheet material with an automated press brake 1 or bending machine 1 described by way of example; on the contrary, such a method according to the invention can be applied in many other ways.

The invention claimed is:

1. An automated press brake or bending machine for bending a workpiece of metal sheet material over one or more required fold lengths and the automated press brake or bending machine having a length, comprising:

a table with a single lower tool holder for receiving bottom tools forming one or several dies and the lower tool holder having a length;

a movable beam or ram with a single upper tool holder for receiving top tools forming one or several punches or folding knives and the upper tool holder having a length;

driving means for moving and arranging the bottom tools and/or the top tools on the upper and lower tool holders; and, a control unit for controlling the driving means;

whereby the one or several dies and the one or several punches or folding knives each have a shape of a tool segment with a width and can be moved back and forth over the length of the respective upper tool holder or the respective lower tool holder, wherein the driving means are integrated in the table and/or ram to move and arrange the bottom tools and/or the top tools respectively and whereby the driving means are such that several tool segments can be simultaneously controlled to make the multiple tool segments undergo a movement, simultaneously and independently from one another, along the upper and lower tool holders, in order to group several tool segments together into an assembled set of tool segments having a width in accordance with a required fold length for making a fold in the workpiece to be processed, whereby several such tool segments are placed next to one another in the length of the press brake or bending machine so as to form such an assembled set of tool segments with which a workpiece of metal sheet material can be folded.

2. The automated press brake or bending machine according to claim 1, wherein an upper groove and a lower groove respectively are provided in the upper tool holder and in the lower tool holder, extending over the length (L) of the press brake or bending machine in which the tool segments can be provided such that they slide back and forth.

3. The automated press brake or bending machine according to claim 1, wherein the control unit is a dynamic control unit with which the tool segments are positionable, in between successive folding operations without any noticeable interruption in the bending process, into an assembled set of tool segments whose middle (M) is centered on the middle (M') of the length (L) of the table and the ram.

4. The automated press brake or bending machine according to claim 1, wherein three or more of the tool segments can be simultaneously controlled by the driving means so as to make the three or more of the tool segments undergo a movement, simultaneously and independently from one another, along the upper and lower tool holder in order to group the three or more tool segments together into the assembled set of tool segments.

5. The automated press brake or bending machine according to claim 1, wherein five or more of the tool segments can be simultaneously controlled by the driving means so as to make the five or more tool segments undergo a movement, simultaneously and independently from one another, along the upper and lower tool holders in order to group the five or more tool segments together into the assembled set of tool segments.

6. The automated press brake or bending machine according to claim 1, wherein there is a space wherein the driving means are present during their operation and wherein this space does not significantly reach into the work area of the bending machine, wherein the driving means occupies less than 2 litres/m of the space adjacent the ram or table.

7. The automated press brake or bending machine according to claim 1, wherein the control unit controls the driving means so that tool segments are moved simultaneously and independently from one another over the upper and lower tool holders so as to form a central assembled set for use during a folding operation and sideways parked tool segments which are not used during a folding operation.

8. The automated press brake or bending machine according to claim 1, wherein the driving means are integrated in the upper and lower tool holders.

9. The automated press brake or bending machine according to claim 1, wherein the driving means contain at least one motor, whereby this motor enables the multiple tool segments to be simultaneously controlled so as to make the multiple tool segments undergo a linear movement, independently from one another, along the upper and lower tool holders.

10. The automated press brake or bending machine according to claim 1, wherein the driving means consist of one or several linear motors which are each formed of a series of electromagnets which are integrated in one of the tool holders, whereby every electromagnet can be electrically controlled separately, whereby every linear motor contains a series of controlled elements, whereby several controlled elements can be simultaneously controlled with the electromagnets so as to make them undergo a linear movement along the upper and lower tool holders and over the respective series of electromagnets, and whereby the controlled elements can be coupled to the tool segments of the upper and lower tool holders.

11. An automated press brake or bending machine according to claim 10, wherein energized electromagnets of the one or several linear motors are fixedly arranged in relation to the ram or the table.

12. The automated press brake or bending machine according to claim 10, wherein the one or several linear motors are one of the following types:

a linear motor with an iron core;

a linear motor with an ironless core;

a variable reluctance linear motor;

a linear motor with permanent magnet; and, a hybrid linear motor, more specifically a combination of a variable reluctance motor and a motor with permanent magnet.

13. The automated press brake or bending machine according to claim 12, wherein the one or several linear motors are a hybrid, linear stepper motor.

14. The automated press brake or bending machine according to claim 10, wherein the bottom tools and/or the top tools are provided with a bearing with which they can be moved in the upper and lower tool holders.

15. The automated press brake or bending machine according to claim 10, wherein the bottom tools and/or the top tools are provided with a controlled coupling having a connecting pin that can be moved in or out of the controlled coupling, with the connecting pin cooperating with one or several connecting holes which are provided in the tool segments.

16. The automated press brake or bending machine according to claim 15, wherein the lower tool holder or the upper tool holder, is provided with a coupling control unit for controlled coupling.

17. The automated press brake or bending machine according to claim 10, wherein the control unit contains one or several drive units, consisting of an electronic circuit which control separate electromagnets and wherein at least one of the drive units can communicate with the control unit.

18. The automated press brake or bending machine according to claim 17, wherein several drive units are placed in series, one after the other, along the whole length (L) of the press brake or the bending machine, whereby the drive units are provided with communication means so as to be able to communicate with the adjacent drive units or sequences of drive units placed in series in view of a common control of the series of electromagnets provided along the whole length (L) of the press brake or the bending machine.

19. An automated press brake or bending machine according to claim 1, wherein the driving means consist of one or several linear motors which are each formed of a series of electromagnets, whereby every linear motor contains a series of controlled elements, whereby several controlled elements can be simultaneously controlled with the electromagnets so as to make them undergo a linear movement along the upper and lower tool holders and over the respective electromagnets, and whereby the controlled elements are mounted fixedly or integrated in each of the tool segments.

20. The automated press brake or bending machine according to claim 1, wherein the driving means contain one or several electric motors which are fixedly mounted on the table or ram for moving and arranging the bottom tools and/or the top tools respectively on the upper and lower tool holders, whereby each tool holder contains one or several controlled elements, whereby every electric motor is provided with transmission means with which a rotating movement generated at the electric motor can be converted into a linear movement of a controlled element along the upper and lower tool holders and whereby the controlled elements can be coupled to the tool segments of the upper and lower tool holders.

21. The automated press brake or bending machine according to claim 20, wherein the transmission means is formed of a belt, a chain or a cable which is driven by the electric motor, which is carried over a roller or pulley and which is connected to or can be coupled to one or several of the controlled elements.

22. The automated press brake or bending machine according to claim 20, wherein the transmission means are formed of a threaded spindle which is driven by the electric motor of the driving means, whereby over the threaded spindle is provided a displacement nut which is connected to or can be coupled to one or several of the controlled elements.

23. The automated press brake or bending machine according to claim 1, wherein the tool holder is provided with retaining means with which a tool segment can be releasably clamped in the tool holder.

24. The automated press brake or bending machine according to claim 1, wherein the control unit contains a CNC control unit which serves as an interface with a user, which determines a position of the controlled elements and controls the operation of the press brake or of the bending machine.

25. The automated press brake or bending machine according to claim 24, wherein the control unit is provided with an intermediate unit which handles the communication between one or several of the drive units and the CNC control unit.

26. The automated press brake or bending machine according to claim 24, wherein the driving means are fixedly arranged on the upper and lower tool holders.

27. The automated press brake or bending machine according to claim 24, wherein the driving means are provided with one or several measuring instruments for measuring either the position of the bottom tools and/or the top tools on the upper and lower tool holders.

28. The automated press brake or bending machine according to claim 27, further comprising a monitor cooperating with the one or several measuring instruments to facilitate information transmission to a user.

29. The automated press brake or bending machine according to claim 1, wherein the upper and lower toolholders each extend over the length of a full working area of the press brake or bending machine.

30. A method for bending metal sheet material with an automated press brake or bending machine according to claim 1, wherein the method comprises:

performing successive folding operations by moving the upper and lower tool holders together and apart to fold the metal sheet material;

repositioning the tool segments in between successive folding operations by means into an assembled set of tool segments having a width in accordance with a required fold length for making a fold in the work piece to be processed; and repositioning the work piece between successive folding operations;

wherein several such tool segments are placed next to one another in the length of the press brake or bending machine between the successive folding operations so as to form such an assembled set of tool segments with which a workpiece of metal sheet material can be folded in such a way that every folding operation can be carried out with an assembled set of tool segments positioned along the tool holder; and wherein the middle (M) of the assembled set of tool segments coincides with the middle (M') of the length (L) of the table and the ram of the press brake or the bending machine.

31. The method according to claim 30, wherein within a time between successive folding operations the tool segments are reconfigured into a new set of tool segments by repositioning, adding, removing, sliding sideways and/or sliding away tool segments, and by moving one or several stops.

32. The method according to claim 30, wherein an operator of the press brake or bending machine performs his work while seated.

* * * * *